US009702576B2

(12) United States Patent
Avedon

(10) Patent No.: US 9,702,576 B2
(45) Date of Patent: Jul. 11, 2017

(54) COLUMNAR AIR MOVING DEVICES, SYSTEMS AND METHODS

(71) Applicant: AIRIUS IP HOLDINGS, LLC, Longmont, CO (US)

(72) Inventor: Raymond B. Avedon, Boulder, CO (US)

(73) Assignee: Airius IP Holdings, LLC, Longmont, CO (US)

( * ) Notice: Subject to any disclaimer, the term of this patent is extended or adjusted under 35 U.S.C. 154(b) by 0 days.

(21) Appl. No.: 14/575,704

(22) Filed: Dec. 18, 2014

(65) Prior Publication Data

US 2015/0176851 A1 Jun. 25, 2015

Related U.S. Application Data

(60) Provisional application No. 61/918,602, filed on Dec. 19, 2013.

(51) Int. Cl.

| | |
|---|---|
| ***F24F 7/00*** | (2006.01) |
| ***F24F 13/08*** | (2006.01) |
| ***F24F 7/007*** | (2006.01) |
| ***F24F 13/06*** | (2006.01) |

(52) U.S. Cl.

CPC ..... *F24F 7/007* (2013.01); *F24F 13/06* (2013.01); *Y10T 29/49815* (2015.01)

(58) Field of Classification Search

CPC ..... F24F 7/007; F24F 13/06; Y10T 29/49185
USPC ..... 454/248
See application file for complete search history.

(56) References Cited

U.S. PATENT DOCUMENTS

| | | | |
|---|---|---|---|
| 917,206 | A | 4/1909 | Watts |
| 1,858,067 | A | 5/1932 | Warren |
| 1,877,347 | A | 9/1932 | McCurdie |
| 1,926,795 | A | 9/1933 | Sassenberg |
| 2,016,778 | A | 10/1935 | Hall et al. |
| 2,189,008 | A | 2/1940 | Kurth |
| 2,189,502 | A | 2/1940 | Johnston |
| 2,232,573 | A | 2/1941 | Teves |
| 2,258,731 | A | 10/1941 | Blumenthal |
| 2,359,021 | A | 9/1944 | Campbell et al. |
| 2,366,773 | A | 1/1945 | Eklund et al. |
| 2,371,821 | A | 3/1945 | Havis |
| D152,397 | S | 1/1949 | Damond |
| 2,513,463 | A | 7/1950 | Eklund et al. |

(Continued)

FOREIGN PATENT DOCUMENTS

| | | |
|---|---|---|
| CN | 1426729 | 7/2003 |
| CN | 10 1592328 | 12/2009 |

(Continued)

OTHER PUBLICATIONS englis translation of an abstract of the document JP01067548A.*

*Primary Examiner* — Helena Kosanovic
(74) *Attorney, Agent, or Firm* — Knobbe Martens Olson & Bear, LLP

(57) ABSTRACT

An air moving system includes an air moving device including a housing member, a rotary fan assembly, and an opening for connection with an airflow duct, the housing including a plurality of air intake vents. A first volume of air can enter the housing through the opening and a second volume of air can enter the housing through the plurality of intake vents. The rotary fan assembly directs the first and second volumes of air.

5 Claims, 23 Drawing Sheets

(56) References Cited

U.S. PATENT DOCUMENTS 2,524,974 A 10/1950 Hickmott
2,615,620 A 10/1952 Goettl
2,632,375 A 3/1953 Stair et al.
2,658,719 A 11/1953 Johanson
2,830,523 A 4/1958 Vehige
2,982,198 A 5/1961 Mohrman
3,012,494 A 12/1961 Drummond
3,036,509 A 5/1962 Babbitt
3,068,341 A 12/1962 Ortiz et al.
D195,287 S 5/1963 Downing
3,099,949 A 8/1963 Davidson
3,165,294 A 1/1965 Anderson
3,188,007 A 6/1965 Myklebust
3,212,425 A 10/1965 Lindner et al.
3,246,699 A 4/1966 Jocz
3,300,123 A 1/1967 Freyholdt et al.
3,320,869 A 5/1967 Schach
3,364,839 A 1/1968 Sweeney et al.
3,382,791 A 5/1968 Henry-Biabaud
3,386,368 A 6/1968 Fielding
3,413,905 A 12/1968 Johnson
3,524,399 A 8/1970 Bohanon
3,584,968 A 6/1971 Keith
3,601,184 A 8/1971 Hauville
3,690,244 A 9/1972 Kallel et al.
3,699,872 A 10/1972 Kruger
3,765,317 A 10/1973 Lowe
3,785,271 A 1/1974 Joy
3,827,342 A 8/1974 Hughes
3,835,759 A 9/1974 Lloyd
3,876,331 A 4/1975 DenHerder et al.
3,927,300 A 12/1975 Wada et al.
3,932,054 A 1/1976 McKelvey
3,934,494 A 1/1976 Butler
3,967,927 A 7/1976 Patterson
3,973,479 A 8/1976 Whiteley
3,988,973 A 11/1976 Honmann
4,006,673 A 2/1977 Meyer et al.
4,152,973 A 5/1979 Peterson
4,185,545 A 1/1980 Rusth et al.
D256,273 S 8/1980 Townsend et al.
4,261,255 A 4/1981 Anderson et al.
4,321,659 A 3/1982 Wheeler
4,344,112 A 8/1982 Brown
4,396,352 A 8/1983 Pearce
4,473,000 A 9/1984 Perkins
4,512,242 A 4/1985 Bohanon, Sr.
4,515,538 A 5/1985 Shih
4,522,255 A 6/1985 Baker
4,524,679 A 6/1985 Lyons
4,546,420 A 10/1985 Wheeler et al.
4,548,548 A 10/1985 Gray, III
4,550,649 A 11/1985 Zambolin
4,630,182 A 12/1986 Moroi et al.
4,662,912 A 5/1987 Perkins
4,678,410 A 7/1987 Kullen
4,681,024 A 7/1987 Ivey
4,715,784 A 12/1987 Mosiewicz
4,716,818 A 1/1988 Brown
4,730,551 A 3/1988 Peludat
4,790,863 A 12/1988 Nobiraki et al.
4,794,851 A 1/1989 Kurrle
4,796,343 A 1/1989 Wing
4,848,669 A 7/1989 George
4,850,265 A 7/1989 Raisanen
4,890,547 A 1/1990 Wagner et al.
4,895,065 A 1/1990 Lamparter
D308,416 S 6/1990 Brumbach
4,930,987 A 6/1990 Stahl
4,971,143 A 11/1990 Hogan
4,973,016 A 11/1990 Hertenstein
5,000,081 A 3/1991 Gilmer
5,021,932 A 6/1991 Ivey
5,033,711 A 7/1991 Gregorich et al.
5,042,366 A 8/1991 Panetski et al.
5,078,574 A 1/1992 Olsen
D325,628 S 4/1992 Cho
5,107,755 A 4/1992 Leban et al.
5,121,675 A 6/1992 Muller et al.
5,127,876 A 7/1992 Howe et al.
5,152,606 A 10/1992 Borraccia et al.
5,156,568 A 10/1992 Ricci
5,191,618 A 3/1993 Hisey
D340,765 S 10/1993 Joss et al.
5,251,461 A * 10/1993 Fallows, III ..... F24F 13/08 454/201
5,328,152 A 7/1994 Castle
5,358,443 A 10/1994 Mitchell et al.
5,399,119 A 3/1995 Birk et al.
5,429,481 A 7/1995 Liu
5,439,352 A 8/1995 Line
5,443,625 A 8/1995 Schaffhausen
5,458,505 A 10/1995 Prager
5,462,484 A 10/1995 Jung et al.
5,511,942 A 4/1996 Meier
5,513,953 A 5/1996 Hansen
5,520,515 A 5/1996 Bailey et al.
5,547,343 A 8/1996 Jané et al.
5,561,952 A 10/1996 Damron
5,569,019 A 10/1996 Katariya et al.
5,584,656 A 12/1996 Rose
5,595,068 A 1/1997 Amr
5,613,833 A 3/1997 Wolfe et al.
5,658,196 A 8/1997 Swaim
5,664,872 A 9/1997 Spearman et al.
5,709,458 A 1/1998 Metz
5,725,356 A 3/1998 Carter
5,791,985 A 8/1998 Schiedegger et al.
5,822,186 A * 10/1998 Bull ..... H05K 7/20172 165/80.3
5,918,972 A 7/1999 Van Belle
5,934,783 A 8/1999 Yoshikawa
D414,550 S 9/1999 Bloom
5,947,816 A 9/1999 Schiedegger et al.
5,967,891 A 10/1999 Riley et al.
5,997,253 A 12/1999 Fechan
6,004,097 A 12/1999 Wark et al.
6,068,385 A 5/2000 Hsieh
6,095,671 A 8/2000 Hutain
6,109,874 A 8/2000 Steiner
6,145,798 A 11/2000 Janisse et al.
6,149,513 A 11/2000 Lyu
6,155,782 A 12/2000 Hsu
6,168,517 B1 1/2001 Cook
6,176,680 B1 1/2001 Ringblom et al.
6,183,203 B1 2/2001 Grintz
6,192,702 B1 2/2001 Shimogori
6,196,915 B1 3/2001 Schiedegger et al.
6,352,473 B1 3/2002 Clark
6,360,816 B1 3/2002 Wagner
6,361,428 B1 3/2002 Tosconi et al.
6,361,431 B1 3/2002 Kawano
6,364,760 B1 4/2002 Rooney
6,383,072 B2 5/2002 Schiedegger et al.
6,384,494 B1 5/2002 Avidano et al.
6,386,828 B1 5/2002 Davis et al.
6,386,970 B1 5/2002 Vernier, II et al.
6,386,972 B1 5/2002 Schiedegger et al.
6,435,964 B1 8/2002 Chang
6,458,028 B2 10/2002 Snyder
6,458,628 B1 * 10/2002 Distefano ..... H01L 21/565 257/E21.504
6,484,524 B1 11/2002 Ulanov
6,551,185 B1 4/2003 Miyake et al.
6,575,011 B1 6/2003 Busby et al.
6,581,974 B1 6/2003 Ragner et al.
6,582,291 B2 6/2003 Clark
6,592,328 B1 7/2003 Cahill
6,595,747 B2 7/2003 Bos
6,626,003 B1 9/2003 Kortüm et al.
6,626,636 B2 9/2003 Bohn
6,648,752 B2 11/2003 Vernier, II et al.
6,679,433 B2 1/2004 Gordon et al.
6,682,308 B1 1/2004 Fei et al.

(56) References Cited

U.S. PATENT DOCUMENTS 6,700,266 B2 3/2004 Winkel et al.
6,767,281 B2 7/2004 McKee
6,783,578 B2 8/2004 Tillman, Jr.
6,804,627 B1 10/2004 Marokhovsky et al.
6,805,627 B2 10/2004 Marts et al.
6,812,849 B1 11/2004 Ancel
6,886,270 B2 5/2005 Gilmer
6,916,240 B1 7/2005 Morton
6,938,631 B2 9/2005 Gridley
6,951,081 B2 10/2005 Bonshor
6,966,830 B2 11/2005 Hurlstone et al.
6,974,381 B1 12/2005 Walker et al.
D514,688 S 2/2006 Avedon
7,011,578 B1 3/2006 Core
7,044,849 B2 5/2006 Dippel
7,048,499 B2 5/2006 Mathson et al.
7,056,092 B2 6/2006 Stahl
7,101,064 B2 9/2006 Ancel
7,152,425 B2 12/2006 Han et al.
7,166,023 B2 1/2007 Haigh et al.
7,175,309 B2 2/2007 Craw et al.
7,185,504 B2 3/2007 Kasai et al.
7,201,110 B1 4/2007 Pawlak
7,201,650 B2 4/2007 Demerath et al.
7,214,035 B2 5/2007 Bussieres et al.
7,288,023 B2 10/2007 Leopold
7,320,636 B2 1/2008 Seliger et al.
7,331,764 B1 2/2008 Reynolds et al.
7,374,408 B2 5/2008 Savage et al.
7,381,129 B2 6/2008 Avedon
7,467,931 B2 12/2008 O'Toole
7,497,773 B1 3/2009 Schmidt
7,516,578 B2 4/2009 Bonshor
7,544,124 B2 6/2009 Polston
7,549,258 B2 6/2009 Lajewski
7,566,034 B2 7/2009 Bonshor
7,607,935 B2 10/2009 Dahl
7,610,726 B2 11/2009 Lajewski
7,645,188 B1 1/2010 Peerbolt
7,651,390 B1 1/2010 Profeta et al.
7,677,770 B2 3/2010 Mazzochette
7,677,964 B1 3/2010 Bucher et al.
7,708,625 B2 5/2010 Leseman et al.
7,752,814 B2 7/2010 Bonshor
7,774,999 B2 8/2010 McKee
7,780,510 B2 8/2010 Polston
D631,148 S 1/2011 Benton et al.
7,901,278 B2 3/2011 O'Hagin
7,930,858 B2 4/2011 Lajewski
8,052,386 B1 11/2011 Fitzpatrick et al.
D672,863 S 12/2012 Romero Carreras
D681,184 S 4/2013 Romero Carreras
8,529,324 B2 9/2013 Moredock et al.
8,596,596 B2 12/2013 Naji et al.
8,616,842 B2 12/2013 Avedon
D698,916 S 2/2014 Avedon
8,967,983 B2 3/2015 Kampf
8,992,174 B2 3/2015 Chang
9,151,295 B2 10/2015 Avedon
D746,971 S 1/2016 Avedon
9,335,061 B2 5/2016 Avedon
9,459,020 B2 10/2016 Avedon
2001/0049927 A1* 12/2001 Toepel ..... B01D 46/0002 55/385.2
2002/0045420 A1 4/2002 Taillon
2002/0137454 A1 9/2002 Baker
2003/0092373 A1* 5/2003 Kuo ..... F24F 13/06 454/248
2004/0050077 A1 3/2004 Kasai et al.
2004/0052641 A1 3/2004 Chen
2004/0240214 A1 12/2004 Whitlow et al.
2004/0253095 A1 12/2004 Sasaki et al.
2005/0092888 A1 5/2005 Gonce
2005/0159101 A1 7/2005 Hrdina et al.
2005/0202776 A1* 9/2005 Avedon ..... F04D 25/088 454/230
2006/0087810 A1 4/2006 Rockenfeller
2006/0172688 A1 8/2006 Johnson
2006/0276123 A1 12/2006 Sanagi et al.
2006/0284435 A1 12/2006 Vitito
2007/0213003 A1 9/2007 Railkar et al.
2007/0297906 A1 12/2007 Wu
2008/0019836 A1 1/2008 Butz et al.
2008/0188175 A1 8/2008 Wilkins
2008/0227381 A1 9/2008 Avedon
2009/0041580 A1 2/2009 Wichmann et al.
2009/0155080 A1 6/2009 Yu
2009/0170421 A1 7/2009 Adrian et al.
2009/0219727 A1 9/2009 Weaver
2009/0262550 A1 10/2009 Inoue
2010/0009621 A1 1/2010 Hsieh
2010/0052495 A1 3/2010 Liu et al.
2010/0176706 A1 7/2010 Fu et al.
2010/0192611 A1 8/2010 Yamaguchi et al.
2010/0202932 A1 8/2010 Danville
2010/0266400 A1 10/2010 Avedon
2011/0037368 A1 2/2011 Huang
2011/0057551 A1 3/2011 Lee et al.
2011/0057552 A1 3/2011 Weaver
2011/0080096 A1 4/2011 Dudik et al.
2011/0084586 A1 4/2011 Lain et al.
2011/0133622 A1 6/2011 Mo et al.
2011/0140588 A1 6/2011 Chen
2011/0223016 A1* 9/2011 Ediger ..... F04D 25/08 415/213.1
2012/0195749 A1 8/2012 Avedon
2013/0011254 A1 1/2013 Avedon
2013/0023195 A1 1/2013 Avedon
2013/0027950 A1 1/2013 Avedon
2013/0196588 A1* 8/2013 Liao ..... F24F 1/01 454/338
2014/0314560 A1 10/2014 Avedon
2015/0176834 A1 6/2015 Avedon
2015/0354578 A1 12/2015 Avedon
2016/0146222 A1 5/2016 Avedon
2016/0186765 A1 6/2016 Avedon
2016/0238029 A1 8/2016 Avedon

FOREIGN PATENT DOCUMENTS

CN 201 560 963 8/2010
DE 44 13 542 10/1995
DE 196 38 518 4/1998
DE 10 2008 04487 3/2010
EP 0 037 958 10/1981
EP 0 212 749 3/1987
EP 0 772 007 5/1997
EP 2 248 692 11/2010
FR 0 715 101 11/1931
FR 2 784 423 4/2000
GB 0 824 390 11/1959
GB 0 981 188 1/1965
GB 2 344 619 6/2000
GB 2 468 504 9/2010
JP 55-032965 3/1980
JP 61-502267 10/1986
JP 01067548 A * 3/1989
JP 07-167097 7/1995
JP 07-253231 10/1995
JP 08-219939 8/1996
JP 11-132543 5/1999
JP 2001-193979 7/2001
JP 2002-349489 12/2002
JP 2006-350237 12/2006
JP 2010-181124 8/2010
KR 20-0176664 4/2000
KR 2003-0025428 3/2003
KR 10-1255739 4/2013
RU 2400254 C2 9/2010
TW M337636 8/2008
WO WO 01/34983 5/2001
WO WO 2005/091896 10/2005
WO WO 2006/078102 7/2006

(56) References Cited

FOREIGN PATENT DOCUMENTS

| | | |
|---|---|---|
| WO | WO 2008/062319 | 5/2008 |
| WO | WO 2010/046536 | 4/2010 |
| WO | WO 2010/114702 | 10/2010 |
| WO | WO 2011/067430 | 6/2011 |
| WO | WO 2012/174155 | 12/2012 |
| WO | WO 2012/174156 | 12/2012 |
| WO | WO 2015/187856 | 12/2015 |
| WO | WO 2016/081693 | 5/2016 |

* cited by examiner

COLUMNAR AIR MOVING DEVICES, SYSTEMS AND METHODS

CROSS-REFERENCE TO RELATED APPLICATIONS

This application claims benefit under 35 U.S.C. 119(e) to U.S. Provisional Patent Application No. 61/918,602, filed Dec. 19, 2013, the entire disclosure of which is hereby incorporated by reference herein in its entirety. Any and all priority claims identified in the Application Data Sheet, or any corrections thereto, are hereby incorporated by reference under 37 CFR 1.57.

This application is related to U.S. Patent Publication No. 2013/0023195, filed Jun. 13, 2012, which is incorporated in its entirety by reference herein.

This application is also related to U.S. Patent Publication No. 2013/0011254, entitled Columnar Air Moving Devices, Systems and Methods, filed Jun. 13, 2012, and to U.S. Patent Publication No. 2013/0027950, entitled Columnar Air Moving Devices, Systems and Methods, filed Jun. 13, 2012, each of which is incorporated in its entirety by reference herein. This application is also related to U.S. Patent Publication No. 2008/0227381, filed May 30, 2008, and to U.S. Patent Publication No. 2010/0266400, filed Mar. 16, 2010, each of which is incorporated in its entirety by reference herein.

BACKGROUND OF THE INVENTIONS

Field of the Inventions

The present application relates generally to systems, devices and methods for moving air that are particularly suitable for creating air temperature de-stratification within a room, building, or other structure.

Description of the Related Art

The rise of warm air and the sinking of cold air can create significant variation in air temperatures between the ceiling and floor of buildings with conventional heating, ventilation and air conditioning systems. Air temperature stratification is particularly problematic in any spaces with any ceilings such as warehouses, gymnasiums, offices, auditoriums, hangers, commercial buildings, offices, residences with cathedral ceilings, agricultural buildings, and other structures, and can significantly increase heating and air conditioning costs. Structures with both low and high ceiling rooms can often have stagnant or dead air, as well, which can further lead to air temperature stratification problems.

One proposed solution to air temperature stratification is a ceiling fan. Ceiling fans are relatively large rotary fans, with a plurality of blades, mounted near the ceiling. The blades of a ceiling fan have a flat or airfoil shape. The blades have a lift component that pushes air upwards or downwards, depending on the direction of rotation, and a drag component that pushes the air tangentially. The drag component causes tangential or centrifugal flow so that the air being pushed diverges or spreads out. Conventional ceiling fans are generally ineffective as an air de-stratification device in relatively high ceiling rooms because the air pushed by conventional ceiling fans is not maintained in a columnar pattern from the ceiling to the floor, and often disperses or diffuses well above the floor.

Another proposed solution to air temperature stratification is a fan connected to a vertical tube that extends substantially from the ceiling to the floor. The fan can be mounted near the ceiling, near the floor or in between. This type of device can push cooler air up from the floor to the ceiling or warmer air down from the ceiling to the floor. Such devices, when located away from the walls in an open space in a building, interfere with floor space use and are not aesthetically pleasing. When confined to locations only along the walls of an open space, such devices may not effectively circulate air near the center of the open space. Examples of fans connected to vertical tubes are disclosed in U.S. Pat. No. 3,827,342 to Hughes, and U.S. Pat. No. 3,973,479 to Whiteley.

A more practical solution is a device, for example, with a rotary fan that minimizes a rotary component of an air flow while maximizing axial air flow quantity and velocity, thereby providing a column of air that flows from a high ceiling to a floor in a columnar pattern with minimal lateral dispersion without a physical transporting tube. Examples of this type of device are described in U.S. patent application Ser. No. 12/130,909, filed May 30, 2008, and U.S. Pat. No. 8,616,842, filed Mar. 16, 2010, each of which is incorporated in its entirety by reference herein.

SUMMARY OF THE INVENTION

An aspect of at least one of the embodiments disclosed herein includes the realization that it would be beneficial to have a columnar air moving device that has a low vertical profile, such that the device can fit into the ceiling structure of a building without extending below the ceiling to an extent that it is distracting or obstructive, and can fit within two generally horizontal ceiling structures.

Another aspect of at least one of the embodiments disclosed herein includes the realization that it would be beneficial to have a columnar air moving device that is designed specifically to fit within a ceiling grid structure, such that it is easy to install, remove, and replace the columnar air moving device if required.

Another aspect of at least one of the embodiments disclosed herein includes the realization that rooms within a building often have support beams or other structures that can make it difficult to install a columnar air moving device (or devices) within the room and direct the air to a predefined area. It would be advantageous to have a columnar air moving device that is configured to have a nozzle or other structure that can be rotated or moved, so as to direct the column of air towards a desired area generally away from an area directly below the columnar air moving device.

Thus, in accordance with at least one embodiment described herein, an air moving system can comprise a ceiling structure comprising a first ceiling level forming a base portion of the ceiling, the first ceiling level having a plurality of grid cells, each grid cell bordered by a grid cell periphery structure, the ceiling structure further comprising a second ceiling level separated from the first ceiling level by a first height, an air moving device positioned at least partially within one of the grid cells in the first ceiling level, the air moving device comprising a housing member forming an interior space within the air moving device, the housing member having a top surface, the housing member being positioned within the ceiling structure such that the top surface is located between the first and second ceiling levels, a lip member forming an outer peripheral edge of air moving device, at least part of the lip member supported by the grid cell periphery structure, the housing member comprising a plurality of air vents for directing a volume of air into the interior space of the air moving device, a rotary fan assembly mounted in the interior space, the rotary fan assembly comprising an impeller and a plurality of blades, the rotary fan assembly configured to direct the volume of air within the interior space, and a nozzle communicating with and extending downwardly from the rotary fan assembly, the nozzle comprising a structure for further directing the volume of air out of the air moving device.

In accordance with at least another embodiment, an air moving device can comprise a housing member forming an interior space within the air moving device, the housing member comprising a plurality of air vents for directing a volume of air into the interior space of the air moving device, a rotary fan assembly mounted in the interior space, the rotary fan assembly comprising an impeller and a plurality of blades, the rotary fan assembly configured to direct the volume of air within the interior space, and a nozzle communicating with and extending downwardly from the rotary fan assembly, the nozzle comprising a structure for further directing the volume of air out of the air moving device, wherein the air moving device comprises a longitudinal axis, the housing member comprises an opening for insertion of the nozzle, and the nozzle comprises at least one spherical surface configured to fit within the opening such that the nozzle can be adjusted preferably at various angles relative to the longitudinal axis.

In accordance with at least one embodiment described herein, an air moving device can include a housing member forming an interior space within the air moving device, the housing member having a first opening for fluidly connecting the interior space with an air flow duct and for directing a first volume of air from the air flow duct into the interior space, and a second opening having a plurality of air vents for directing a second volume of air into the interior space of the housing member. The air moving device can also include a rotary fan assembly mounted in the interior space, the rotary fan assembly having an impeller and a plurality of blades, the rotary fan assembly configured to direct the first and second volumes of air within the interior space.

In accordance with at least one embodiment described herein, an air moving device can include a housing member forming an interior space within the air moving device, the housing member having an opening that fluidly connects the interior space with air outside of the housing; a ceiling support structure connected to the housing member and forming an outer peripheral edge of the air moving device; and an air vent grill assembly configured to be positioned at least partially within the housing member, the air vent grill assembly having an outer rim, a plurality of air vents for directing a volume of air into the interior space of the air moving device, and at least one projection configured to releasably attach to the ceiling support structure, the projection including a hinge that allows the air vent grill assembly to rotate relative to the ceiling support structure. The hinge can be a tool-less hinge requiring no tools to move the hinge out of engagement with the ceiling support structure.

In accordance with at least one embodiment described herein, a method of removing an air vent grill assembly from an air moving device can include: disconnecting a first portion (e.g., an outer rim) of an air vent grill assembly from a ceiling support structure of an air moving device, wherein the air vent grill assembly comprises at least one projection extending from the first portion and releasably attached to the ceiling support structure; rotating the first portion about a hinge in the at least one projection; disconnecting the at least one projection from the ceiling support structure; and removing the air vent grill assembly from the ceiling support structure.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENTS

Figure 1:
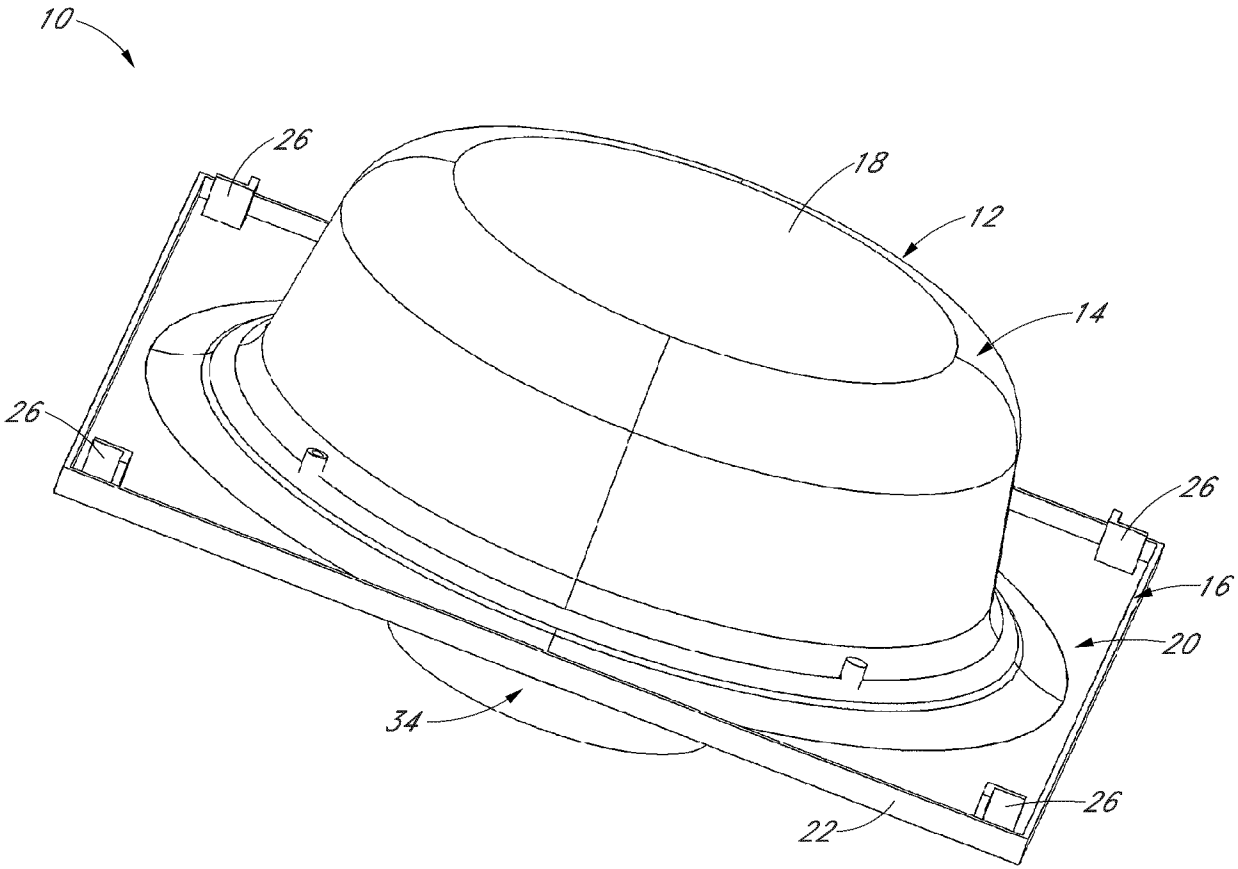
FIG. 1 is a top perspective view of an air moving device in accordance with an embodiment.
Figure 2:
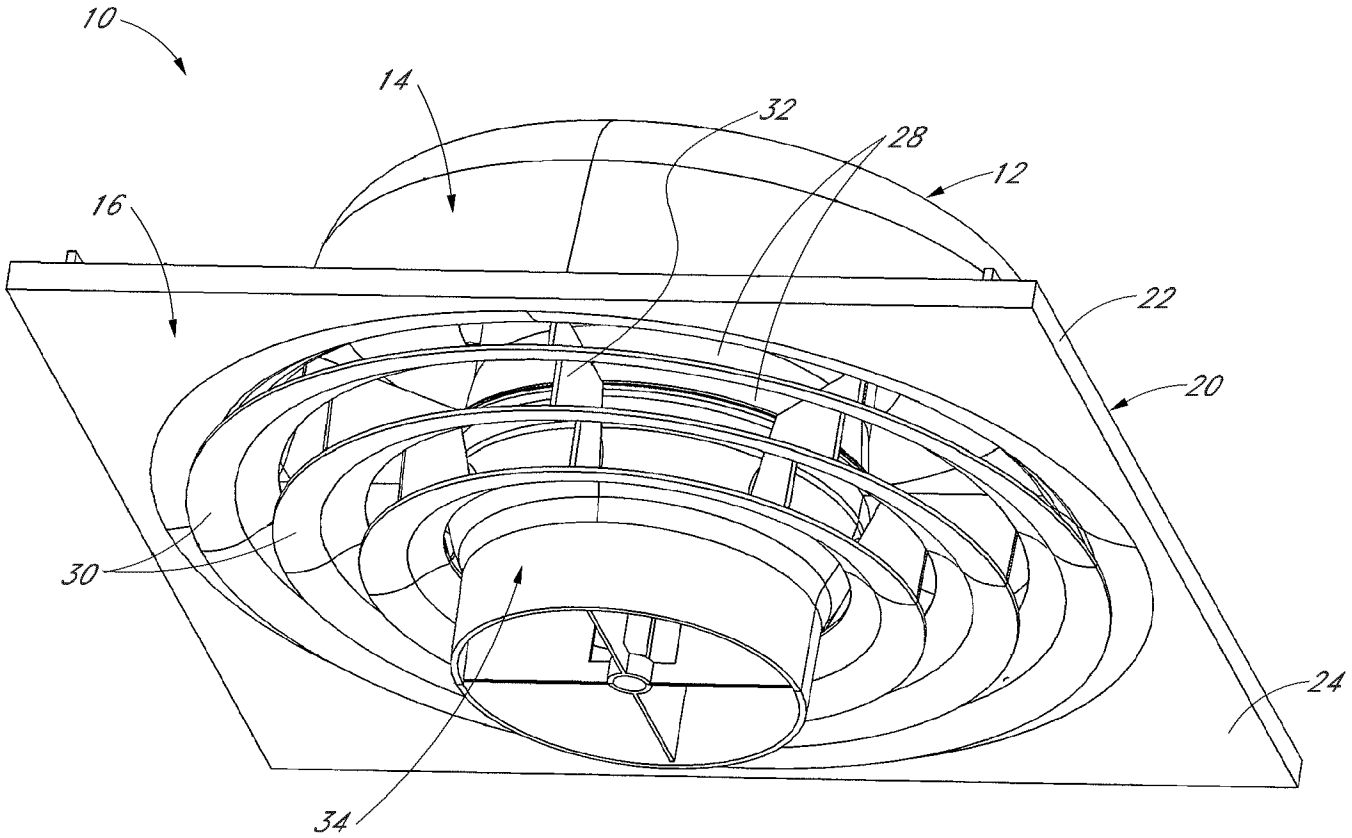
FIG. 2 is a bottom perspective view of the air moving device of FIG. 1.

With reference to FIGS. 1-5, an air moving device 10 can comprise a housing member 12. The housing member 12 can form an outer shell of the air moving device 10, and can at least partially enclose an interior space within the air moving device 10. The housing member 12 can be formed from one or more sections. For example, the housing member 12 can comprise an upper housing section 14, and a lower housing section 16. In some embodiments the upper and lower housing sections 14, 16 can be attached to one another through use of fasteners, adhesive, or other structure. In some embodiments the upper housing section 14 can comprise a dome shape. In some embodiments, the upper housing section 14 can comprise a generally round, circumferentially-shaped structure, and the lower housing section 16 can comprise a generally rectangular-shaped structure. In some embodiments the lower housing section 16 can form an outer periphery of the housing member 12. In some embodiments, the dome shaped upper housing section 14 and rectangular-shaped lower housing section 16 can be integrally formed as a single piece.

Figure 10:
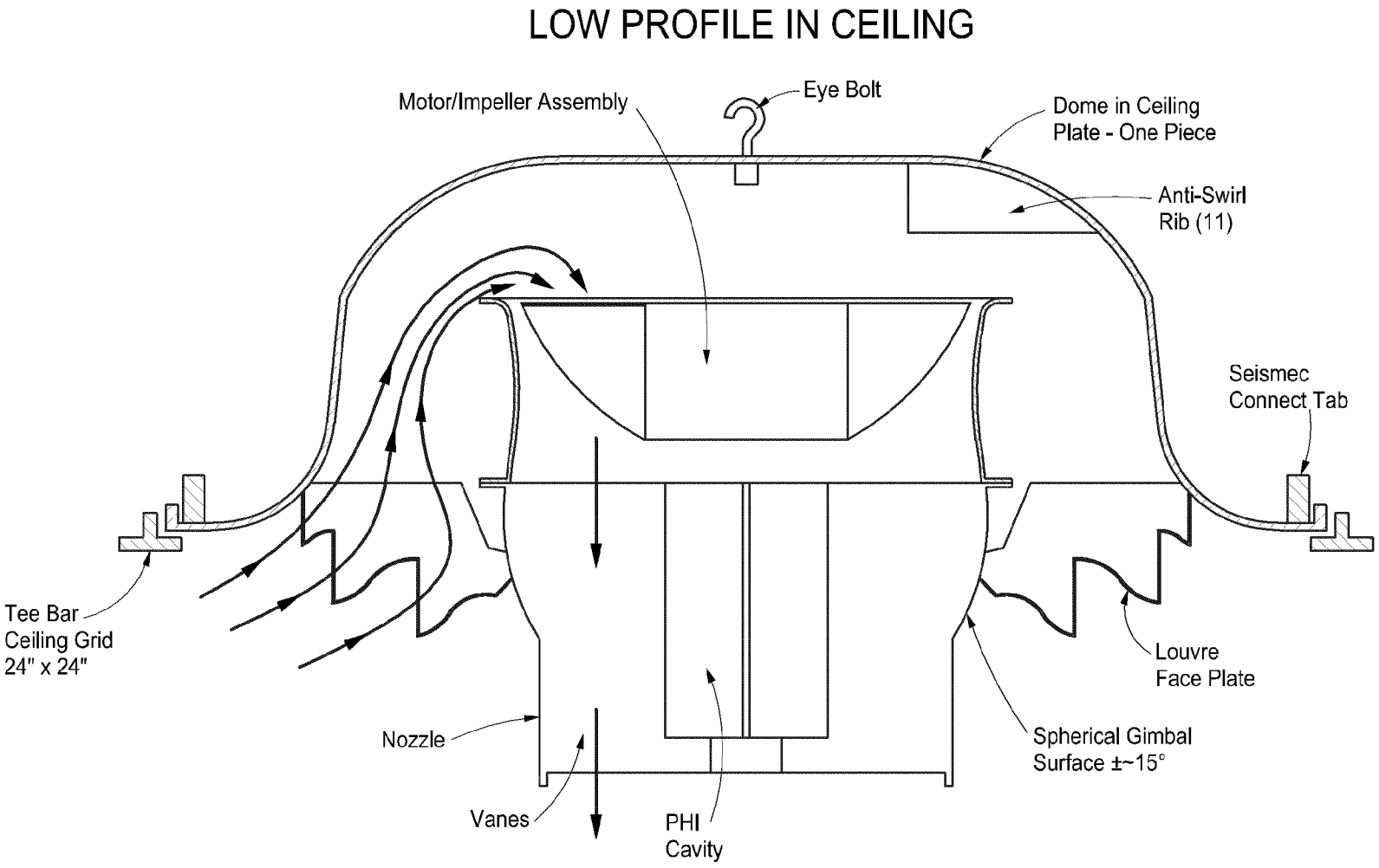
FIG. 10 is a schematic, cross-sectional view of an air moving device in accordance with an embodiment.

The housing member 12 can include a top surface 18. In some embodiments the top surface 18 can include or be attached to a support member. The support member can include, for example, a ring-shaped structure (e.g. an eye-bolt as illustrated in FIG. 10). In some embodiments, the housing member 12 can be hung by the support member, and/or can be attached to another structure with the support member. In some embodiments, and as described further below, the top surface 18, and/or any support member formed from or attached to top surface 18, can be configured to rest between two generally horizontal ceiling structures within an air moving system.

With reference to FIGS. 1-5, the housing member 12 can comprise a ceiling support structure 20. The ceiling support structure 20 can form part of the lower housing section 16. The ceiling support structure 20 can be a separate component attached to the housing member 12. In some embodiments, the ceiling support structure 20 can comprise a lip member. The ceiling support structure 20 can include an outer peripheral edge 22. The outer peripheral edge 22 of the ceiling support structure 20 can form a generally rectangular structure around the air moving device 10, though other shapes are also possible. The outer peripheral edge 22 can form an outer peripheral edge of the air moving device 10. The ceiling support structure 20 can also include a lower surface 24. At least a portion of the lower surface 24 can be configured to rest upon one or more ceiling structures when the air moving device 10 is mounted in a ceiling. The lower surface 24 can be a generally flat surface, though other surfaces are also possible.

With continued reference to FIGS. 1-5, the ceiling support structure 20 can include one or more seismic connect tabs 26. The seismic connect tabs 26 can be used to connect the air moving device 10 to one or more ceiling structures in a ceiling. The seismic connect tabs 26 can permit movement of the air moving device 10 relative to one or more ceiling structures during the event of an earthquake or other similar event.

With continued reference to FIGS. 1-5 and 9, the housing member 12 can comprise at least one air vent 28. The air vent or vents 28 can be configured to direct a volume of air into the interior space of the air moving device 10. For example, the housing member 12 can comprise a plurality of air vents 28 in the lower housing section 16. The plurality of air vents 28 can be spaced directly below the ceiling support structure 20. In some embodiments the air vents 28 can be separated by air vent guides 30. The air vent guides 30 can comprise ring-like structures extending generally circumferentially along the lower housing section 16. In some embodiments the outer diameters of the air vent guides 30 can decrease moving downwardly away from the ceiling support structure 20.

The air vent guides 30 can be connected to air vent face plates 32. The air vent face plates 32 can be spaced circumferentially around the lower housing section 16. The air vent face plates 32, in conjunction with the air vent guides 30, can be configured to direct a volume of air inwardly through the air vents 28, and up into the interior space defined by the housing member 12. The air vent face plates 32 can be solid structures that divide the air vents 28 into sections or portions.

With continued reference to FIGS. 1-4, the air moving device 10 can comprise a nozzle 34. The nozzle 34 can communicate with and extend downwardly from the housing member 12. The nozzle 34 can comprise a structure for directing a volume of air out of the air moving device 10. For example, the nozzle 34 can comprise a structure for directing a volume of air out of the air moving device 10 that has previously entered through the plurality of air vents 28. In some embodiments, the nozzle 34 is attached to the housing member 12.

Figure 6:
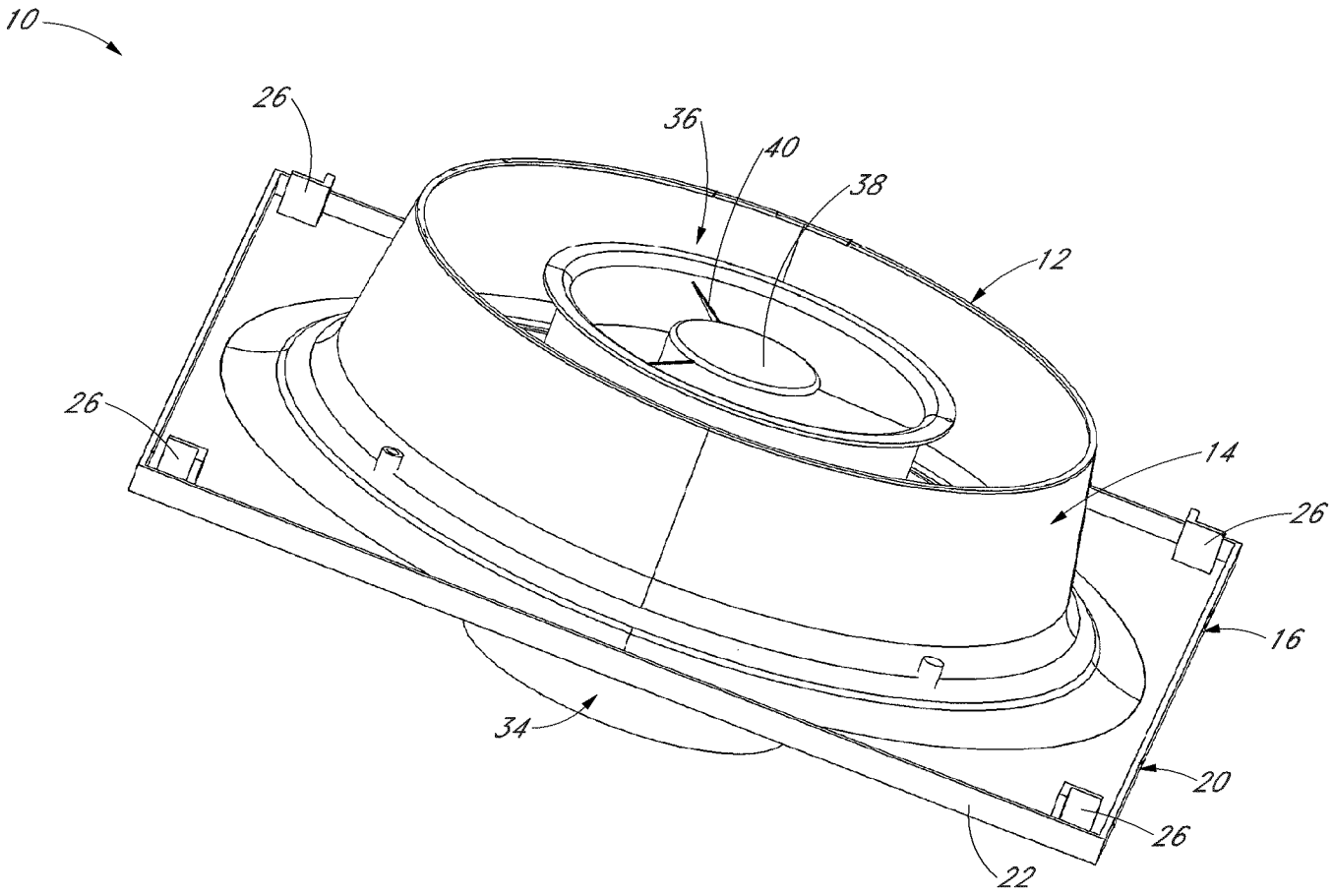
FIG. 6 is a perspective, partial view of the device of FIG. 1, taken along line 6-6 in FIG. 3.
Figure 9:
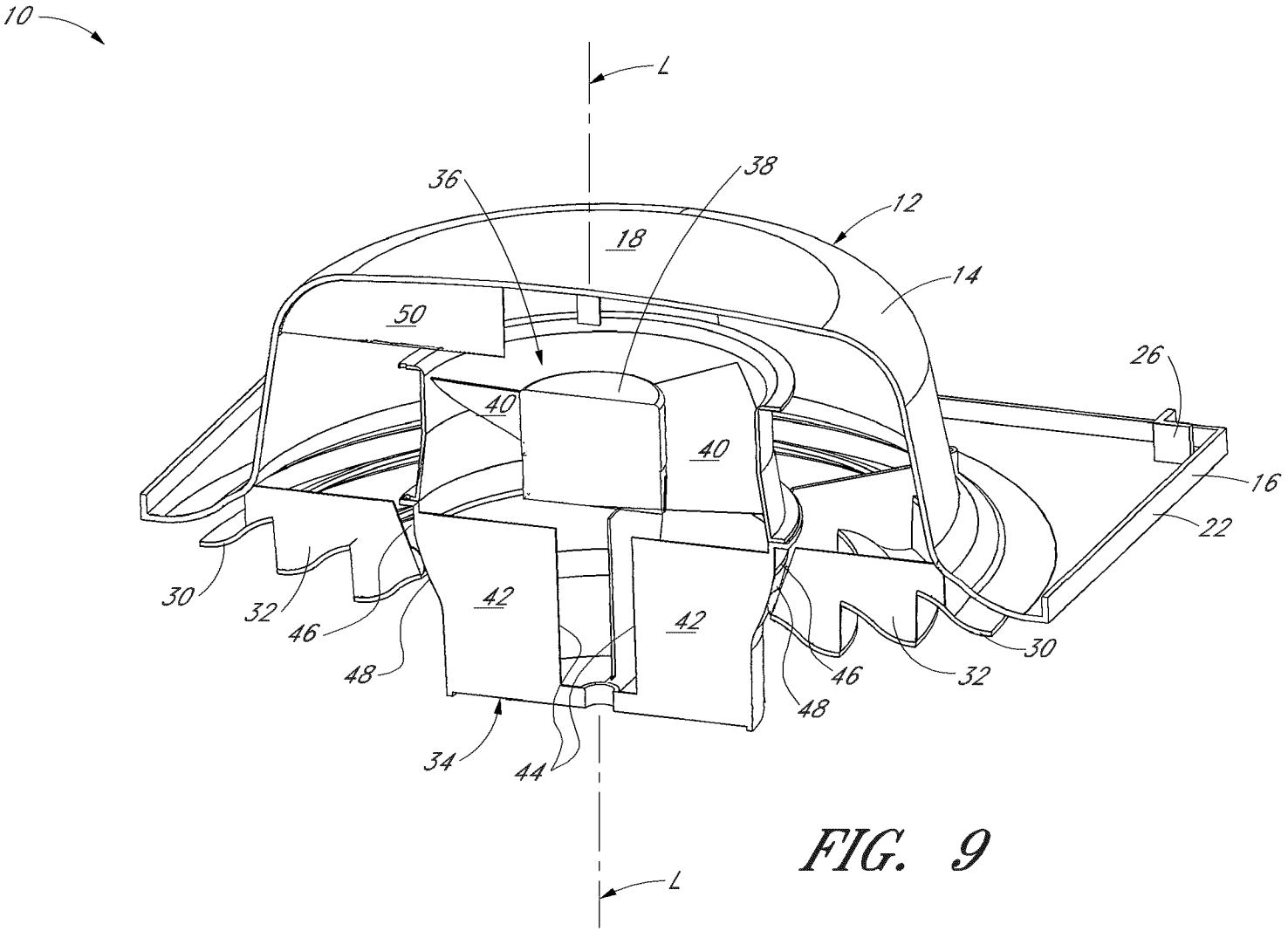
FIG. 9 is cross-sectional view of the device of FIG. 1, taken along line 9-9 in FIG. 3.

With reference to FIGS. 6 and 9, the air moving device 10 can comprise a rotary fan assembly 36 mounted within the interior space. The rotary fan assembly 36 can comprise an impeller 38 and a plurality of blades 40. The rotary fan assembly 36 can be configured to direct a volume of air that has entered through the plurality of air vents 28 downwardly into the nozzle 34. The rotary fan assembly 36 can push, or force, a volume of air downwardly within the interior space of the air moving device 10. The rotary fan assembly 36 can comprise a motor. The rotary fan assembly 36 can comprise at least one electrical component. The rotary fan assembly 36 can be mounted generally above the plurality of air vents 28, such that the volume of air entering the plurality of air vents 28 is required to travel upwardly within the interior space of the air moving device 10 before it can enter the rotary fan assembly 36. In some embodiments, the rotary fan assembly 36 can be mounted to the lower housing section 16. The nozzle 34 can communicate with and extend downwardly from the rotary fan assembly 36. In some embodiments, the nozzle 34 is attached to the rotary fan assembly 36.

Figure 7:
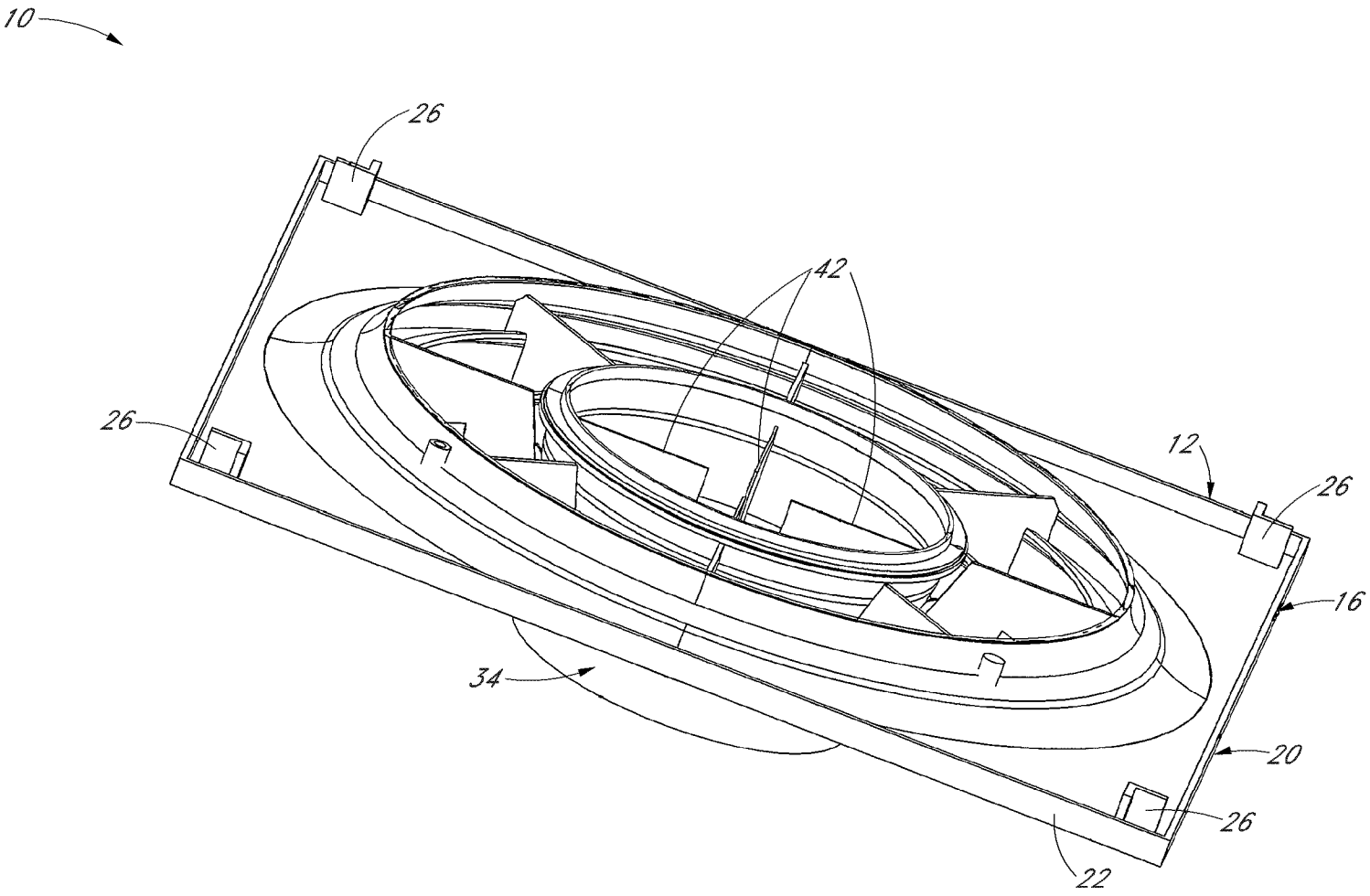
FIG. 7 is a perspective, partial view of the device of FIG. 1, taken along line 7-7 in FIG. 3.
Figure 8:
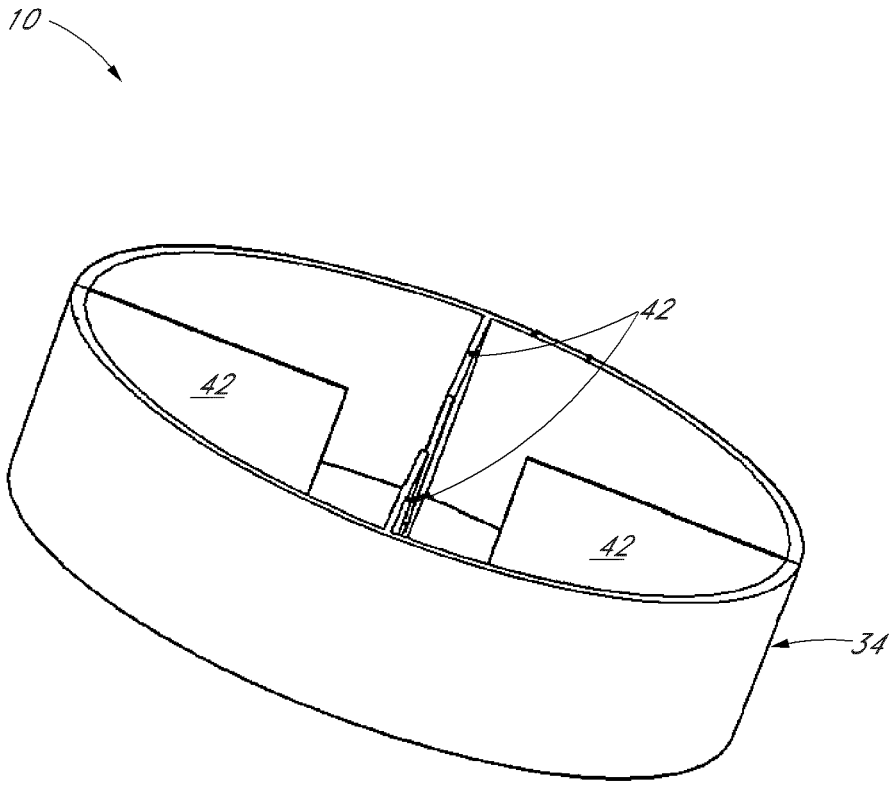
FIG. 8 a perspective, partial view of the device of FIG. 1, taken along line 8-8 in FIG. 3.

With continued reference to FIGS. 7-9, the air moving device 10 can include additional structures that facilitate de-stratification. For example, the nozzle 34 of the air moving device 10 can comprise at least one stator vane 42. The stator vanes 42 can be positioned equidistantly in a circumferential pattern within the nozzle 34. The stator vanes 42 can further direct the volume of air that has entered through the plurality of air vents 28 and has moved into the rotary fan assembly 36 and further down into the nozzle 34. For example, the stator vanes 42 can be used to straighten a volume of air within the nozzle 34. The stator vanes 42 can be used to force a volume of air to move in a generally columnar direction downwardly towards the floor of a building or other structure, with minimal lateral dispersion, similar to the devices described for example in U.S. patent Ser. No. 12/130,909, and U.S. patent application Ser. No. 12/724,799, each of which is incorporated in its entirety by reference herein. In some embodiments, the nozzle 34 can have no stator vanes 42. In some embodiments, the stator vanes can be straight. In some embodiments, the stator vanes can be curved or include a curved portion.

With reference to FIG. 9, in some embodiments the stator vanes 42 can comprise one or more cutouts 44. The cutouts 44 can create space for insertion, for example, of an ionization cell (i.e. a PHI cell). The ionization cell can be used to increase the air quality. The cutouts 44 can form a void or opening in the middle of the nozzle 34, and the ionization cell (not shown) can be inserted into the opening for example during manufacturing. The volume of air moving through the air moving device 10 can run past, alongside, or through the ionization cell, and be treated.

Figure 3:
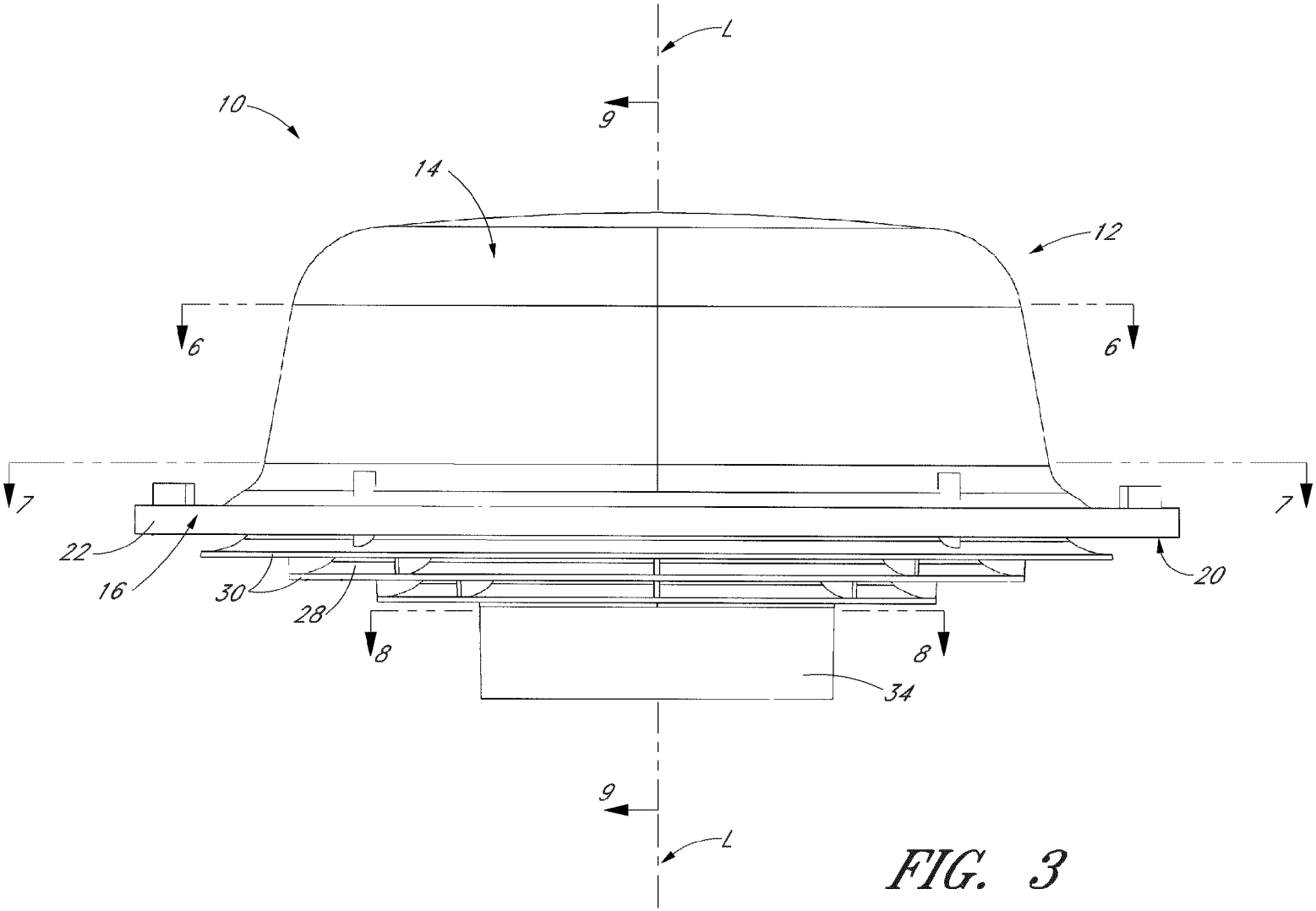
FIG. 3 is a front elevation view of the device of FIG. 1.
Figure 4:
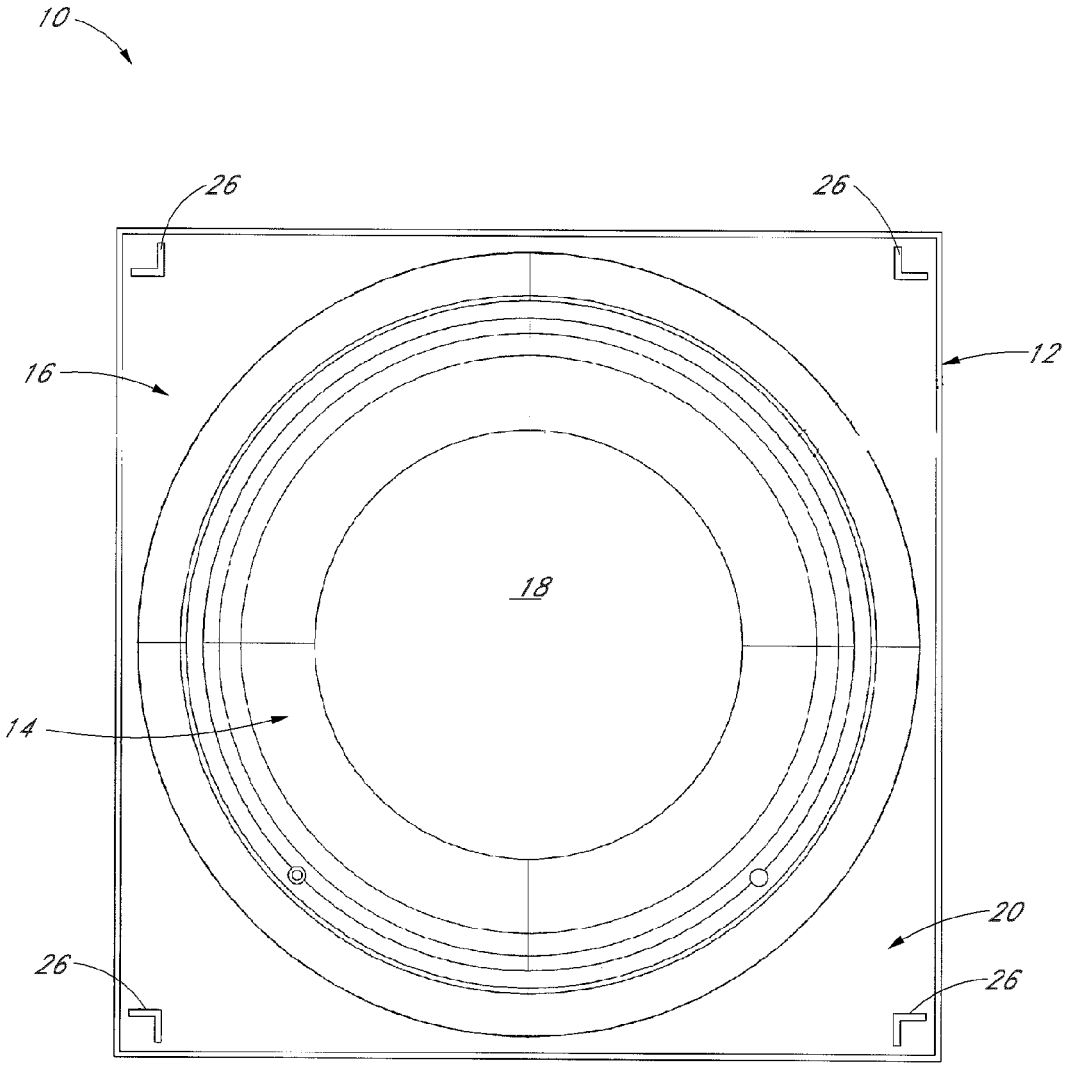
FIG. 4 is a top plan view of the device of FIG. 1.
Figure 5:
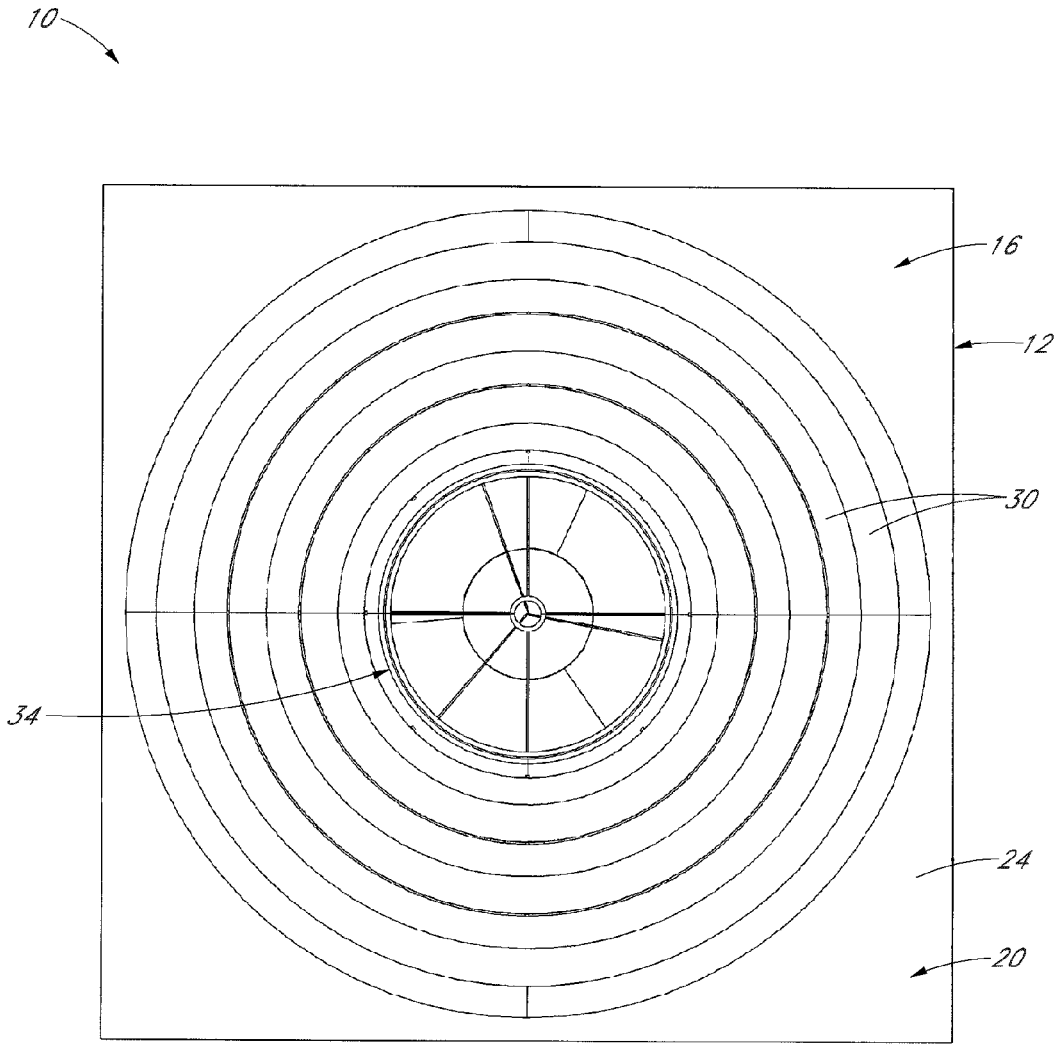
FIG. 5 is a bottom plan view of the device of FIG. 1.

With continued reference to FIGS. 3 and 9, in some embodiments the air moving device 10 can comprise a longitudinal axis L that runs through a middle of the air moving device 10. The housing member 12 can comprise an opening 46 for insertion of the nozzle 34, and the nozzle 34 can comprise at least one spherical surface 48 configured to fit within the opening 46 such that the nozzle 34 can be adjusted angularly relative to the longitudinal axis L. For example, the nozzle 34 can rest within the opening 46, such that the spherical surface 48 contacts the housing member 12, and is not rigidly attached to the housing member 12. In this manner, the housing member 12 can act as a gimbal, allowing pivoted rotational and/or tilting movement of the nozzle 34. The nozzle 34 can be moved at an angle or angles relative the longitudinal axis L, so as to direct the column of air leaving the air moving device 10 towards different directions. In some embodiments, the nozzle 34 can be vertical or angled at least 10 degrees relative to the longitudinal axis L in one or more directions. In some embodiments, the nozzle 34 can be angled at least 15 degrees relative to the longitudinal axis L in one or more directions. In some embodiments the nozzle 30 can be angled at least 20 degrees relative to the longitudinal axis L in one or more directions. In some embodiments, the nozzle 34 can be angled at least 45 degrees relative to the longitudinal axis L in one or more directions. In some embodiments the nozzle 34 can self-lock in place once it has been repositioned. For example, the weight of the nozzle 34, and/or the coefficients of friction of the materials used to create the nozzle 34 and housing member 12, can be such that the nozzle 34 can frictionally lock itself in place in various positions. In some embodiments, the nozzle 34 and/or housing member 12 can incorporate one or more mechanical or other types of mechanisms for locking the nozzle 34 in place once it has been repositioned.

While use of a spherical surface on the nozzle 30 is described and illustrated, other types of mechanisms could also be used to permit relative movement of the nozzle 30, and/or to allow the nozzle 30 to be locked in place in various angular positions.

In some buildings, there are support beams, ductwork, conduit, wiring, or other structures that would otherwise block the flow of a columnar air moving device, or make it difficult for an air moving device to direct air to a desired area. Therefore, at least one benefit achieved by having a nozzle 34 that can be repositioned is the fact that the air moving device 10 can be positioned in or below a ceiling, some distance away from an area in need of de-stratification, and the nozzle 34 can simply be adjusted so as to direct the column of air towards that area of need.

With continued reference to FIG. 9, the air moving device 10 can further comprise at least one anti-swirl member 50. The anti-swirl member 50 can be located within the interior space of the air moving device 10 formed by the housing member 12. In some embodiments, one or more anti-swirl members 50 can be attached to an interior surface of the upper housing section 14. The anti-swirl members 50 can be used to slow down and/or inhibit swirling of air within the interior space located above the rotary fan assembly 36. For example air can be swirling turbulently, at a top of the air moving device 10 after it has entered the device. The anti-swirl members 50 can extend into the space where the air is moving and slow the air down, and/or redirect the air, so that the air is directed more linearly down towards the nozzle 34. It can be desirable to slow down and/or inhibit swirling of air, such that the air can be directed more easily in a generally columnar pattern down through the nozzle 34 with greater ease and efficiency. The anti-swirl members 50 can be used to inhibit turbulence within the air moving device 10. In some embodiments, the anti-swirl members 50 can comprise one or more ribs. The ribs can extend along an inside surface of the housing member 12. The ribs can inhibit a swirling pattern of air.

In some embodiments, the air moving device 10 can be a self-contained unit, not connected to any ductwork, tubing, or other structure within a room or building. The air moving device 10 can be a stand-alone de-stratification device, configured to de-stratify air within a given space.

In some embodiments, the air moving device 10 can have an overall height (extending from the top of the housing member 12 to the bottom of the nozzle 34) that ranges from between approximately one foot to four feet, though other ranges are also possible. For example, in some embodiments the air moving device 10 can have an overall height that ranges from approximately one feet to three feet. In some embodiments the housing member 12 can have an overall outside diameter that ranges from approximately 8 inches to 30 inches, though other ranges are also possible. For example, in some embodiments the housing member 12 can have an overall outside diameter that ranges from approximately 12 inches to 24 inches. In some embodiments, the nozzle 30 can have an outside diameter that ranges between approximately five inches to twelve inches, though other ranges are possible. For example, in some embodiments the nozzle 30 can have an outside diameter that ranges from between approximately eight to ten inches. In some embodiments the air moving device 10 can have a motor with an overall power that ranges between approximately 720 and 760 watts, though other ranges are possible. In some embodiments the air moving device 10 can have a motor with an overall power that can vary from approximately 10 to 740 watts.

Figure 11:
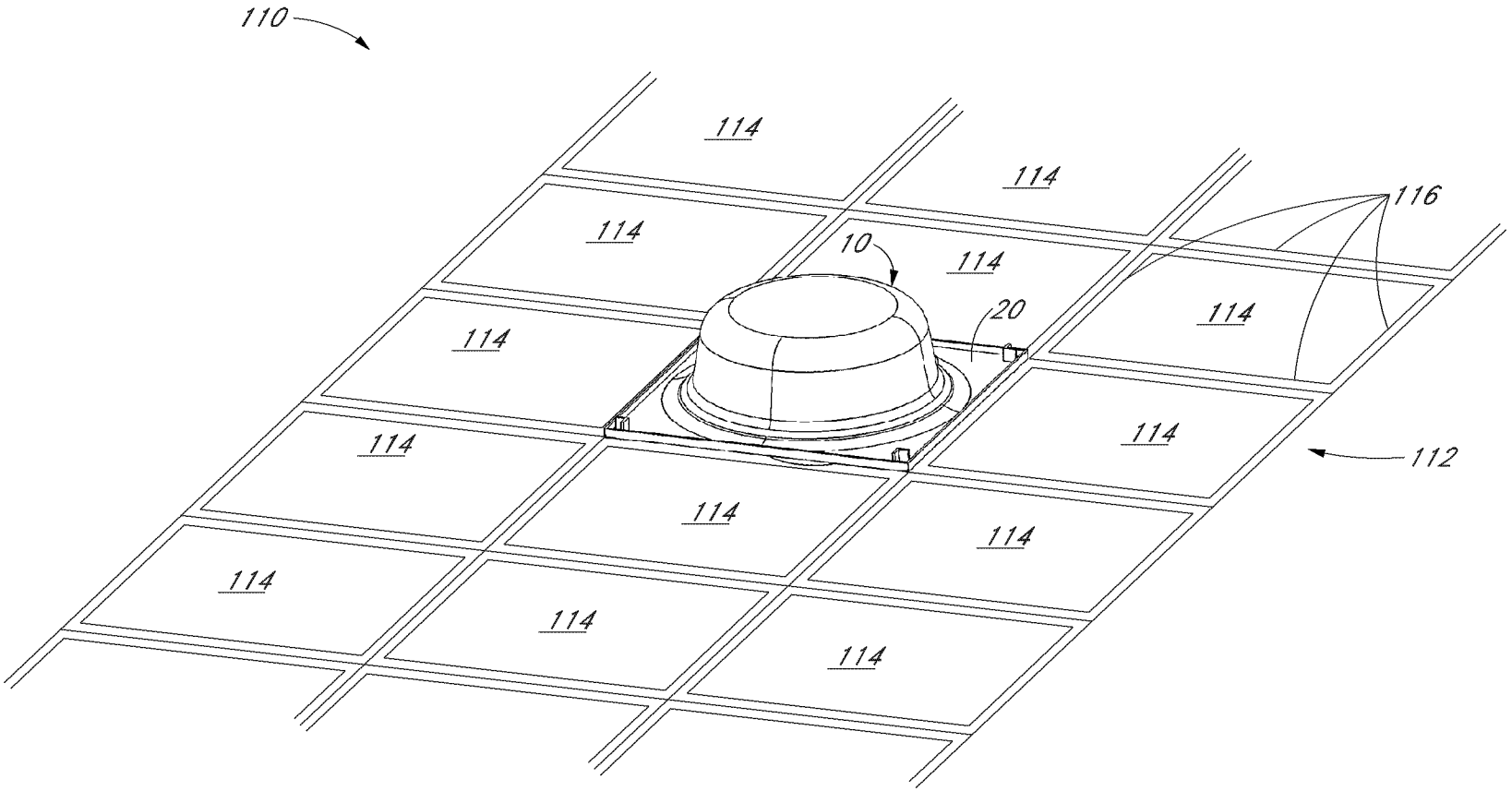
FIG. 11 is a schematic, perspective view of an air moving system in accordance with an embodiment.
Figure 12:
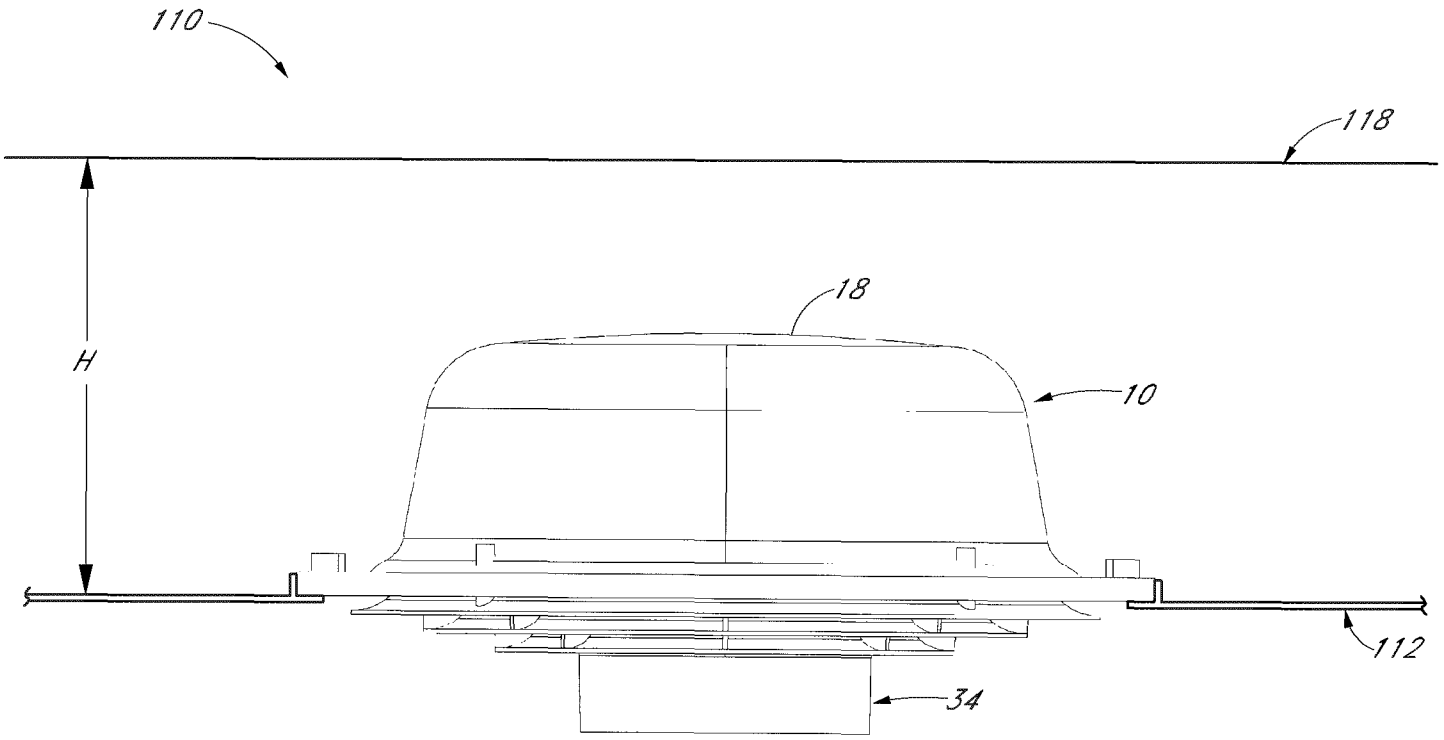
FIG. 12 is a schematic, front elevational view of the air moving system of FIG. 11.

With reference to FIGS. 11 and 12, an air moving system 110 can comprise a first ceiling level 112 forming a base portion of a ceiling in a building or room. The first ceiling level 112 can comprise a plurality of grid cells 114. Each of the grid cells 114 can be bordered by at least one grid cell periphery structure 116. In some embodiments, at least a portion of the grid cell periphery structure 116 can have a t-shaped cross section. In some embodiments, the grid cells 114 can comprise an open space between the grid cell periphery structures 116. The grid cells 114 can be generally rectangular. In some embodiments the grid cells 114 are approximately 24 inches by 24 inches in size, though other sizes and shapes are also possible.

In some embodiments, the ceiling support structure 20 can be configured to rest on or be attached to one or more grid cell periphery structures 116. For example, in some embodiments the air moving device 10 can rest on two grid cell periphery structures 116. In some embodiments the air moving device can rest on four grid cell periphery structures 116. In some embodiments, the grid cell periphery structures 16 can be configured to support the ceiling support structure 20 and air moving device 10. In some embodiments, the grid cell periphery structures 16 are attached to the ceiling support structure 20, for example with at least one fastener. In some embodiments the grid cells 114 can have generally the same outer peripheral profile as the ceiling support structure 20, such that the ceiling support structure 20 is configured to rest on the surrounding grid cell periphery structures 116, and the air moving device 10 fits easily within a single grid cell 114. As described above, seismic connect tabs 26 can be used to provide further connection.

With reference to FIG. 12, the air moving system 110 can further comprise a second ceiling level 118. The second ceiling level 118 can be separated from the first ceiling level 112 by a height H. In some embodiments, both the first and second ceiling levels 112, 118 are generally horizontal structures. In some embodiments the first and second ceiling levels 112, 118 are parallel to one another. As described above, and as illustrated in FIG. 12, an air moving device 10 can be configured to fit within the air moving system 10 such that the top surface 18 is located between the first and second ceiling levels 112, 118. The low vertical profile of the air moving device 10, and in particular the upper housing section 14, advantageously enables the air moving device to fit within this space between the first and second ceiling levels 112, 118.

Overall, the air moving system 110 can permit multiple air moving devices 10 to be supported by or attached to the grid cell periphery structures 116. The air moving devices 10 can be removed, replaced, or moved in the air moving system 110. If required, and as described above, the nozzles 34 can be moved, pivoted, and/or rotated, depending on where it is desired to direct air within a building or room having an air moving system 110.

In some embodiments, the air moving device system 110 can comprise a solid ceiling structure (e.g. a drywall structure). A portion of the ceiling structure can be removed to make room for the air moving device 10. For example, a portion of drywall or other material can be cut out, and the air moving device 10 can be supported by and/or mounted to the ceiling structure in the air moving device system 110, with at least a portion of the air moving device 10 located within the cut-out portion.

In various embodiments, an air moving device can be configured to connect to an airflow conduit or duct, such as those used as part of a heating, ventilation, and air conditioning (HVAC) system; a heating, ventilation, air conditioning, and refrigeration (HVACR) system; or other environmental control system. In such embodiments, the air moving device can be configured to direct air from the airflow conduit to a desired location. For example, in some embodiments an air moving device can be configured to direct warm air from an airflow conduit toward the entrance of a building. This can help keep the floor of the entrance dry and help ensure that individuals entering the building immediately experience the conditioned air.

In some embodiments, an air moving device can also help maintain pressure in the airflow conduit or duct. For example, where an air moving device is connected to a conduit or duct toward the end of the conduit or duct (or other location where pressure tends to fall), a rotary fan assembly in the air moving device can create a negative pressure that draws air to the end of the conduit or duct. Further, operating a rotary fan assembly in an air moving device while operating an HVAC (or other environmental control system) can lead to efficient movement of air since both the fan assembly and pressure within the HVAC conduits help move air. Additionally, if one of the fan assembly or the HVAC system is not activated, the other of the fan assembly or the HVAC system can still help drive air flow. For example, if the HVAC system is not activated, the fan assembly can draw air into the air moving device from a room or other location where the device is located and allow the air moving device to direct the air to a desired location. In some embodiments, the fan assembly can also draw air into the air moving device from the HVAC conduit when the HVAC system is not activated. Similarly, if the fan assembly is not activated, the HVAC system can direct air through the air moving device.

Figure 13:
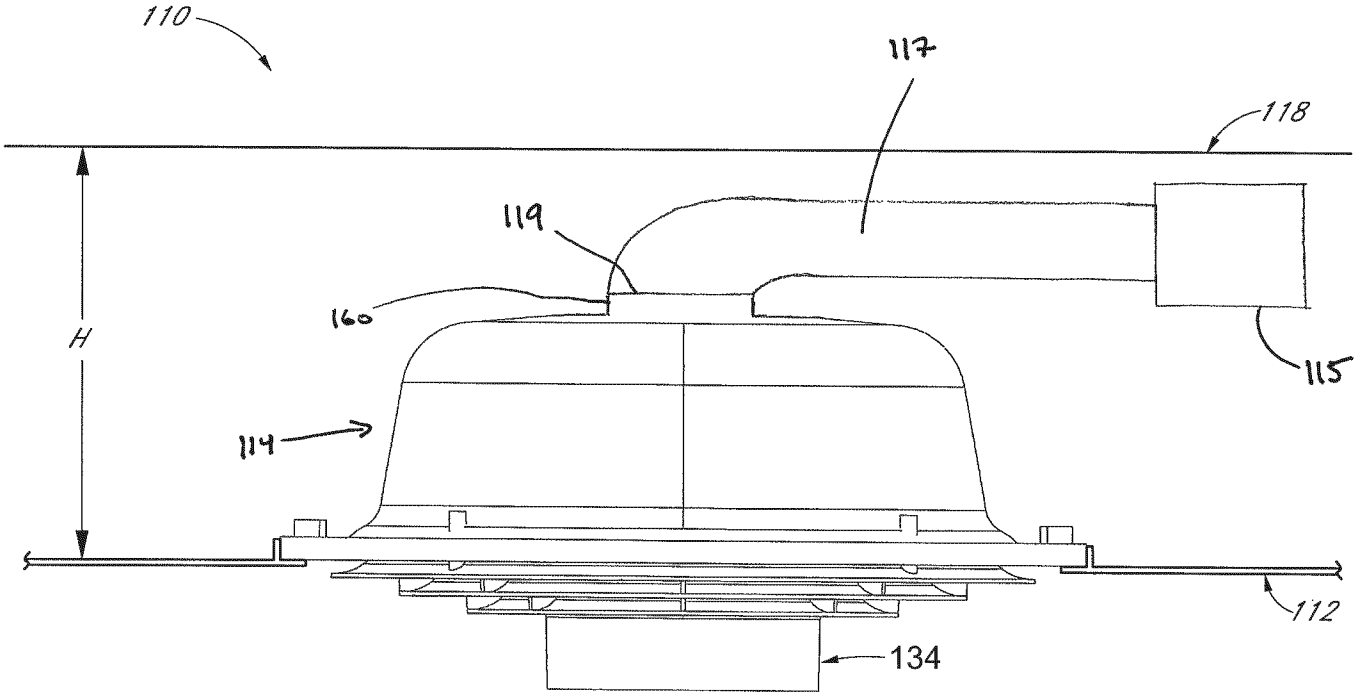
FIG. 13 is a schematic front view of an air moving system in accordance with one embodiment.

FIG. 13 illustrates one embodiment of an air moving device that has been configured to connect to an HVAC or other environmental control system. In some embodiments, an upper housing section 114 of the air moving device can include stubbing or a projection 160 that can be configured to attach to a conduit or duct 115 of the HVAC or other environmental control system. In some embodiments, the projection can connect directly to the conduit or duct. In some embodiments (e.g., where the position of the air moving device is not aligned with the conduit or duct), the projection can connect to a flexible attachment tubing or duct 117 that connects the projection to the conduit 115. In some embodiments, a securing device 119, such as a coil or band, can be used to secure the attachment tubing or duct 117 to the projection. In some embodiments, the upper housing section 114 can have an opening without any projection and that receives a projection from the conduit or duct 115 or from the attachment tubing or duct 117.

Figure 14:
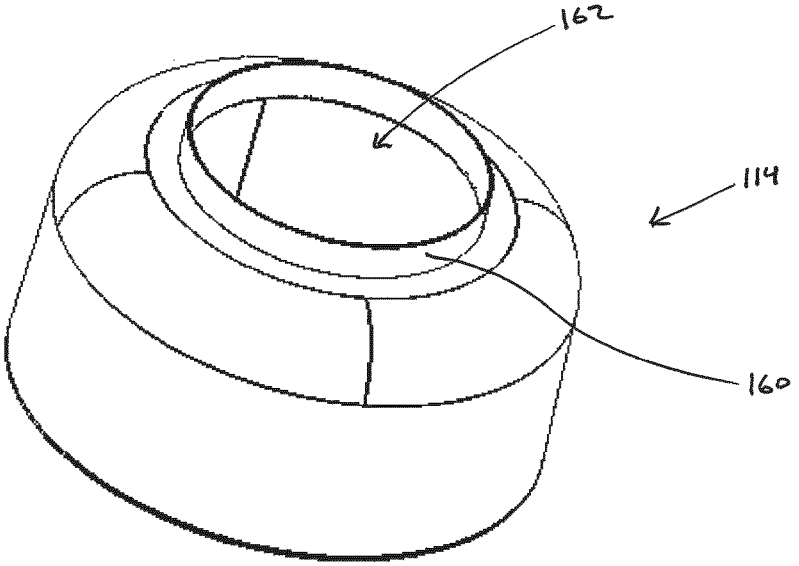
FIG. 14 is a schematic top perspective view of an upper housing section in accordance with one embodiment.
Figure 15:
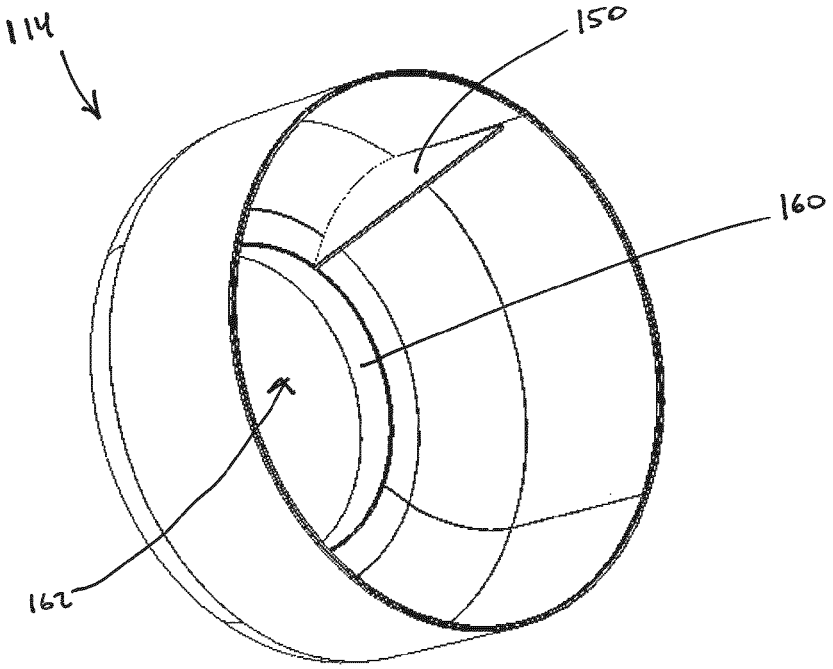
FIG. 15 is a schematic bottom perspective view of the upper housing section of FIG. 14.
Figure 16:
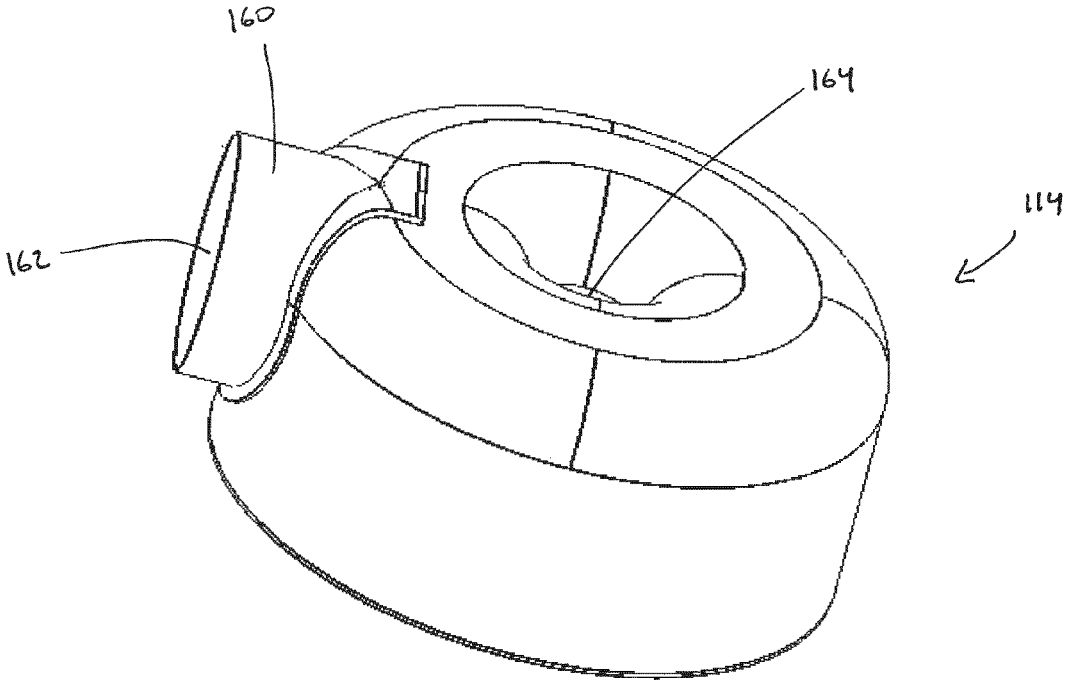
FIG. 16 is a top perspective view of an upper housing section in accordance with one embodiment.
Figure 17:
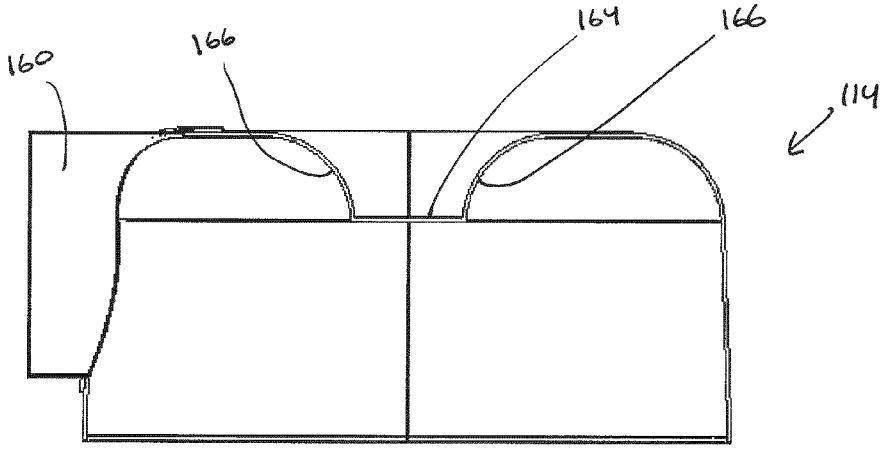
FIG. 17 is a side view of the upper housing section of FIG. 16.

In some embodiments, the upper housing section 114 can be configured to have a projection 160 positioned according to the particular geometry needed for the housing member to connect to a conduit or duct 115. FIGS. 14 and 15 illustrate one embodiment of an upper housing section 114 that includes a projection 160 at a top of the upper housing section. The projection can have an opening 162 that can allow fluid communication between the upper housing section and an airflow duct. FIGS. 16 and 17 illustrate an embodiment of an upper housing section 114 with a projection 160 that extends laterally from a side of the upper housing section. In some embodiments, an opening in the projection can be sized to fit standard conduit connection points. For example, in some embodiments the opening can have a diameter of 6 inches, 8 inches, 10 inches, or 12 inches. In some embodiments it can have other diameters. In some embodiments, it can be configured to match the particular conduit to which it will connect.

The upper housing section 114 of FIGS. 13-17 can be used and configured according to any embodiments discussed herein. For example, in some embodiments an air moving device that connects to a conduit or duct can also include a rotary fan assembly and at least one air vent configured to draw a volume of air from outside of the conduit and outside of the device into the interior space of the air moving device. Additionally, components not specifically called out can be considered to operate like similar components described elsewhere herein. Further, components called out with similar numbers can be considered to operate similarly unless otherwise described. For example, in some embodiments an upper housing section 114 can include one or more anti-swirl members 150 that can operate similarly to the anti-swirl members 50 discussed above.

In some embodiments, as further illustrated in FIGS. 16 and 17, an upper housing section 114 can include an inset portion 164 on a top of the housing member. The inset portion can define guide walls 166 in an interior of the housing member that can help direct airflow from the outer regions of the housing toward a center of the housing from where it can be directed out of the housing, such as through a nozzle. In some embodiments, the guide walls can direct airflow through a fan assembly before the air exits the housing. Any of the various embodiments described herein can be adapted to include an inset portion 164 and/or guide walls 166.

In some embodiments, it can be desirable for an air moving device to be configured to allow for the removal of various components so that they can be cleaned, adjusted, repaired, maintained, or otherwise modified as desired. FIGS. 18-23 relate to such embodiments. The components and features discussed with respect to FIGS. 18-23 can be used and configured according to any embodiments discussed herein. Components not specifically called out can be considered to operate like similar components described elsewhere herein. Further, components called out with similar numbers can be considered to operate similarly unless otherwise described. For example, in some embodiments an upper housing section 214 or ceiling support structure 220 can include one or more seismic connect tabs 226 that can operate similarly to the seismic connect tabs 26 discussed above.

Figure 18:
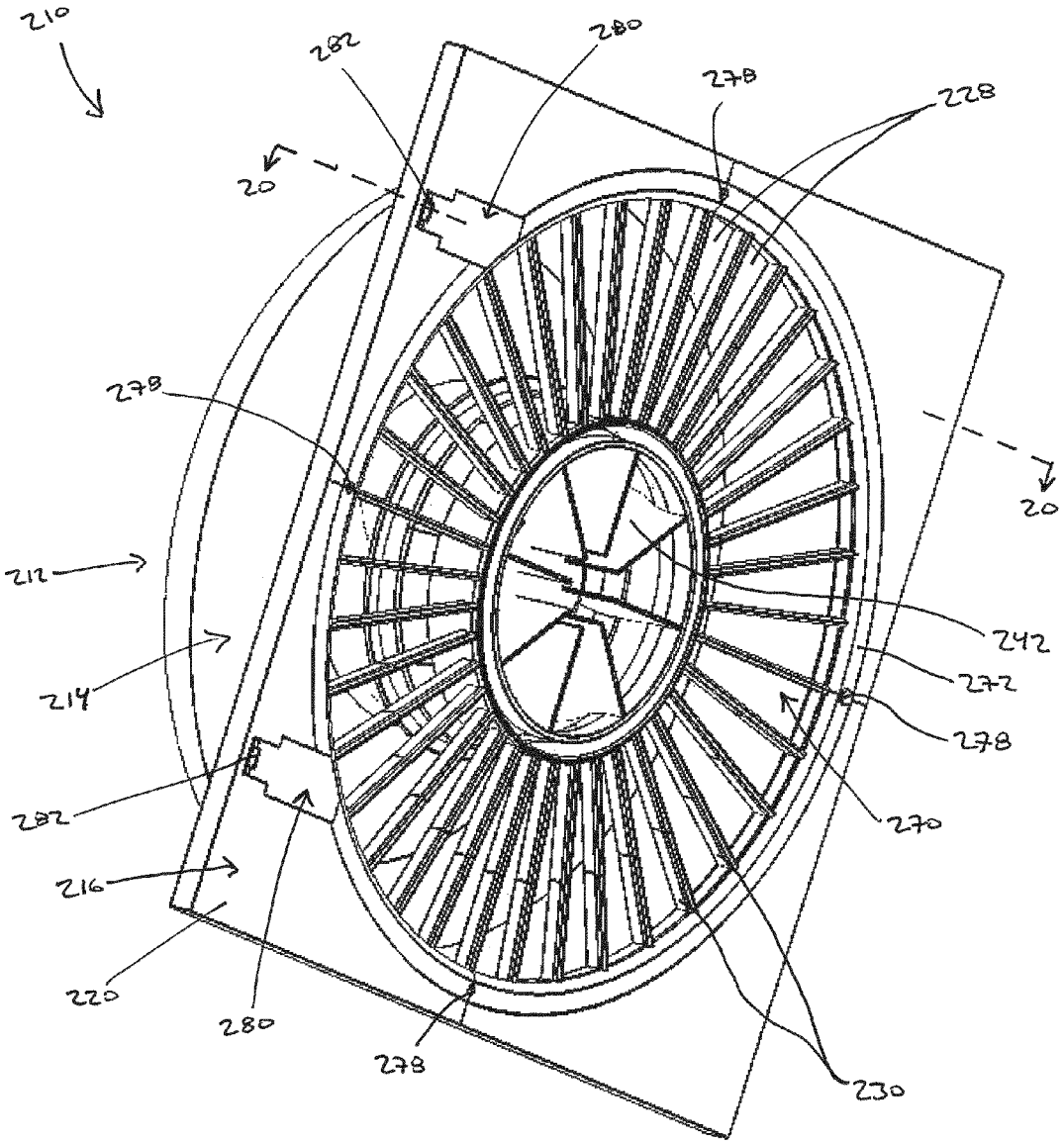
FIG. 18 is a schematic perspective view of an air moving device in accordance with one embodiment.

FIG. 18 illustrates one embodiment of an air moving device 210 that includes a removable grill assembly 270 to assist with cleaning, adjustment, repair, or other modifications of the air moving device 210. The grill assembly can include a plurality of air vents 228 that can direct a volume of air into the interior space of the air moving device 210. The air vents can be separated by air vent guides 230. In some embodiments, the air vent guides can be circumferential, as described above. In some embodiments, as illustrated, the air vent guides 230 can extend radially. Radially extending guides 230 can reduce interference with a volume of air moving into the interior of the air moving device 210.

In some embodiments, the grill assembly 270 can be releasably secured to the housing member 212, such as by attaching to the lower housing section 216. Any form of releasable attachment can be used, such as clips, bolts, screws, interlocking components, etc. As shown, in some embodiments screws 278 can be used to secure the grill assembly 270. The screws can be inserted through an outer rim 272 of the grill assembly 270 and into the lower housing section 216, such as in a ceiling support structure 220.

In some embodiments, the grill assembly 270 can also include a connecting projection 280 that can include an articulation, such as a hinge 282. The hinge can allow the grill assembly 270 to rotate out of a closed position within the housing member 212 while still remaining connected to the housing member 212. This can allow an operator or technician to clean or otherwise service components (e.g., the motor, rotary fan, vanes) within the interior of the housing member 212 and/or clean or otherwise service components of the grill assembly 270 without having to completely remove the grill assembly 210 and/or housing 212 from the ceiling. The hinge 282 can be a tool-less hinge (e.g., a hinge capable of rotation with respect to and attachment/removal from the ceiling or ceiling support structure without use of tools).

Figure 19A:
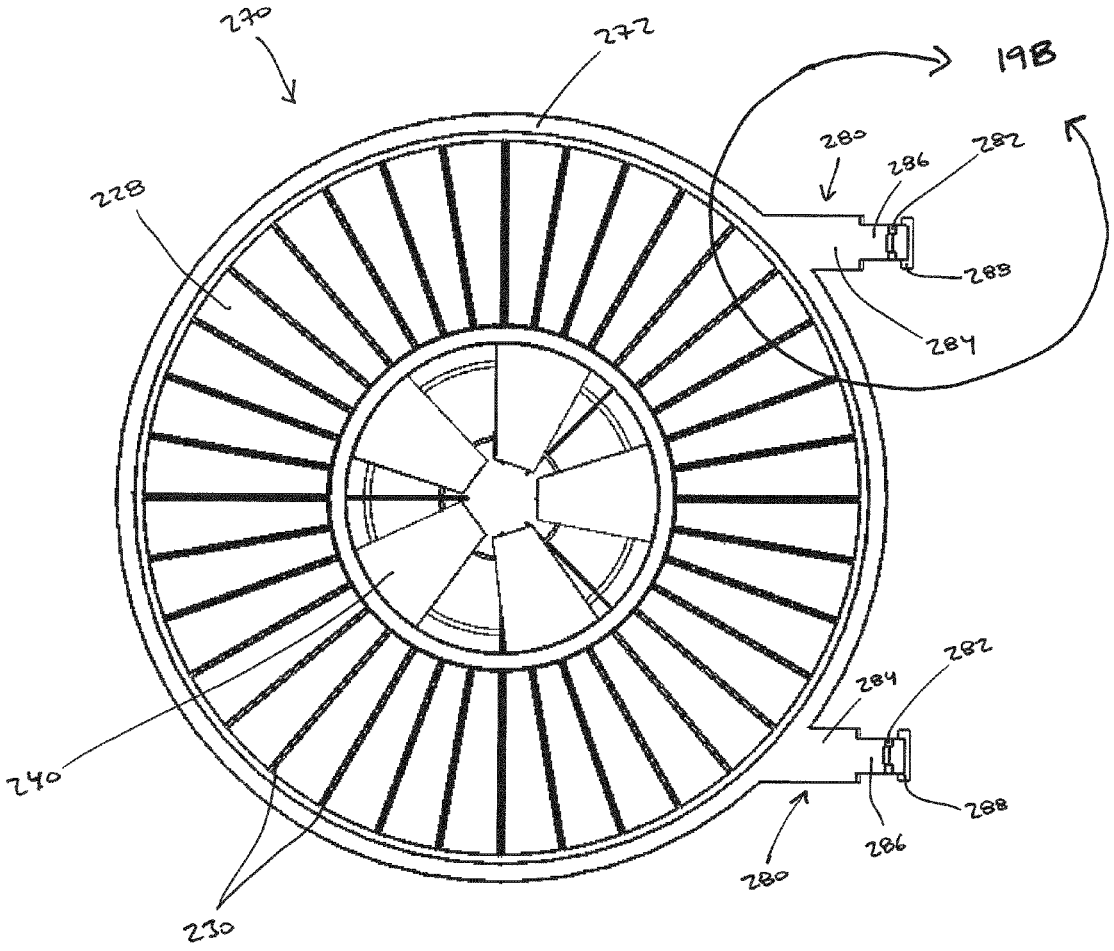
FIG. 19A is a top perspective view of a removable grill assembly in accordance with one embodiment.
Figure 19B:
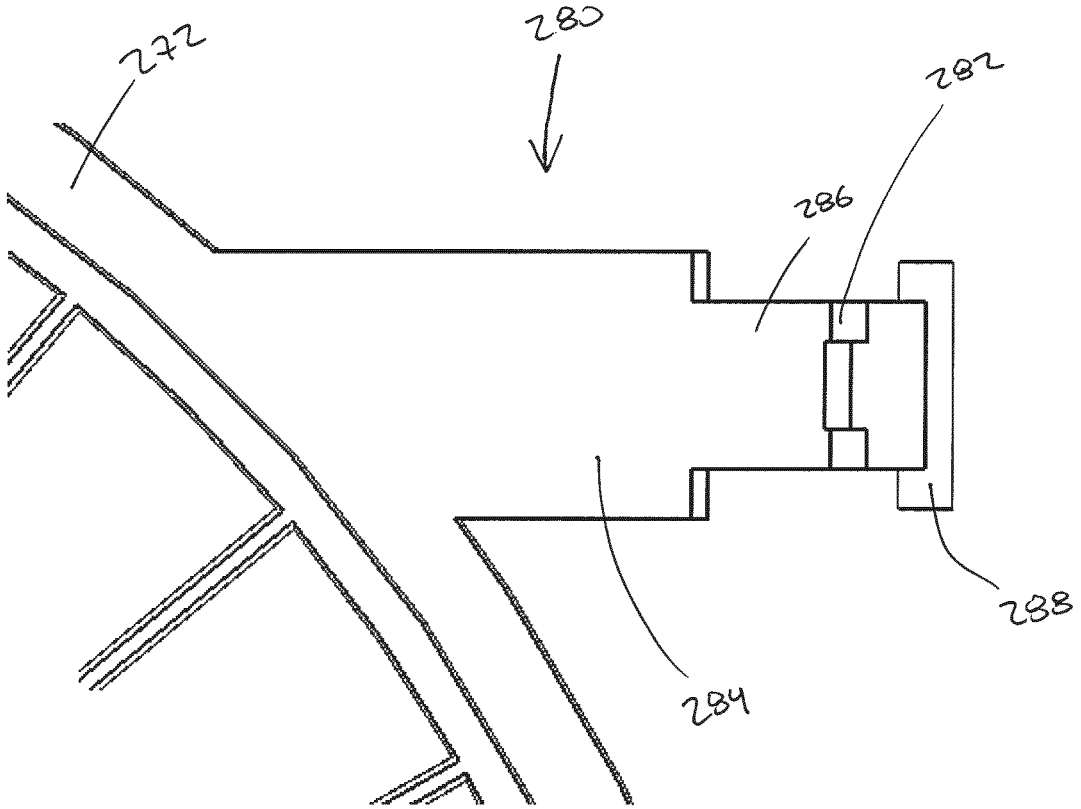
FIG. 19B is a view of the connecting projection of FIG. 19A.
Figure 20:
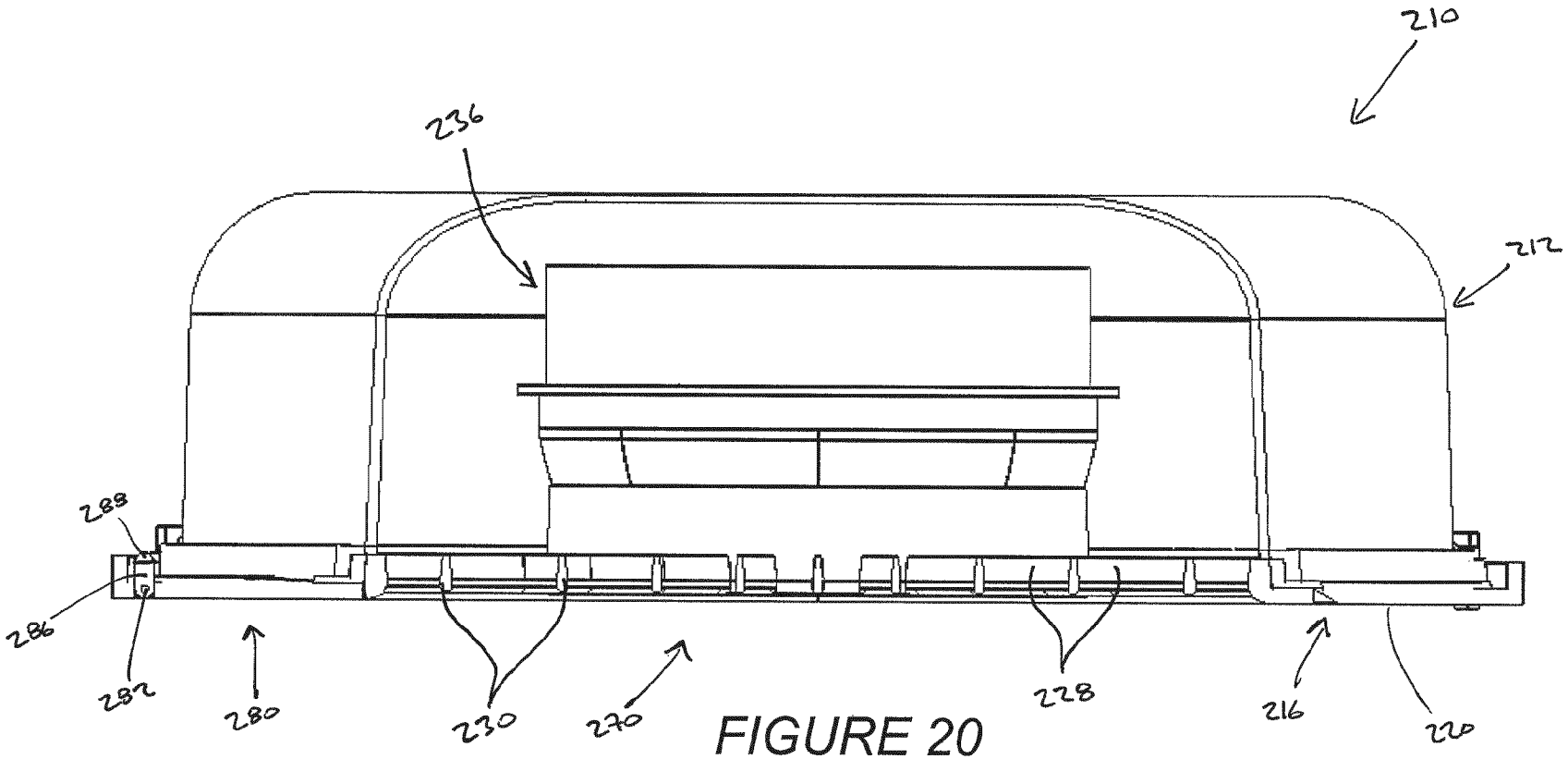
FIG. 20 is a cross-sectional view of the air moving device of FIG. 18, taken along the line 20-20.

FIG. 19A illustrates a top view of a grill assembly 270 and FIG. 19B illustrates a connecting projection 280 of FIG. 19A. In some embodiments, as shown, the connecting projection 280 can include a proximal, wider section 284 and a distal, narrower section 286. The distal section can include the hinge 282 and an elongate connection member 288, such as a pin, that is attached to the distal section 286. FIG. 20 illustrates a cross-sectional view of one embodiment of an air moving device 210 that includes a removable grill assembly 270. In some embodiments, when the grill assembly is in a closed position as shown, the connecting projection 280 can be rotated at the hinge 282. Preferably, in the closed position the grill assembly 270 can be flush or generally flush with a lower housing section 216, such as at a ceiling support structure 220. In some embodiments, as illustrated, the grill assembly does not have a nozzle. In some embodiments, the grill assembly 270 may include a nozzle according to any of the nozzle embodiments discussed above.

Figure 21:
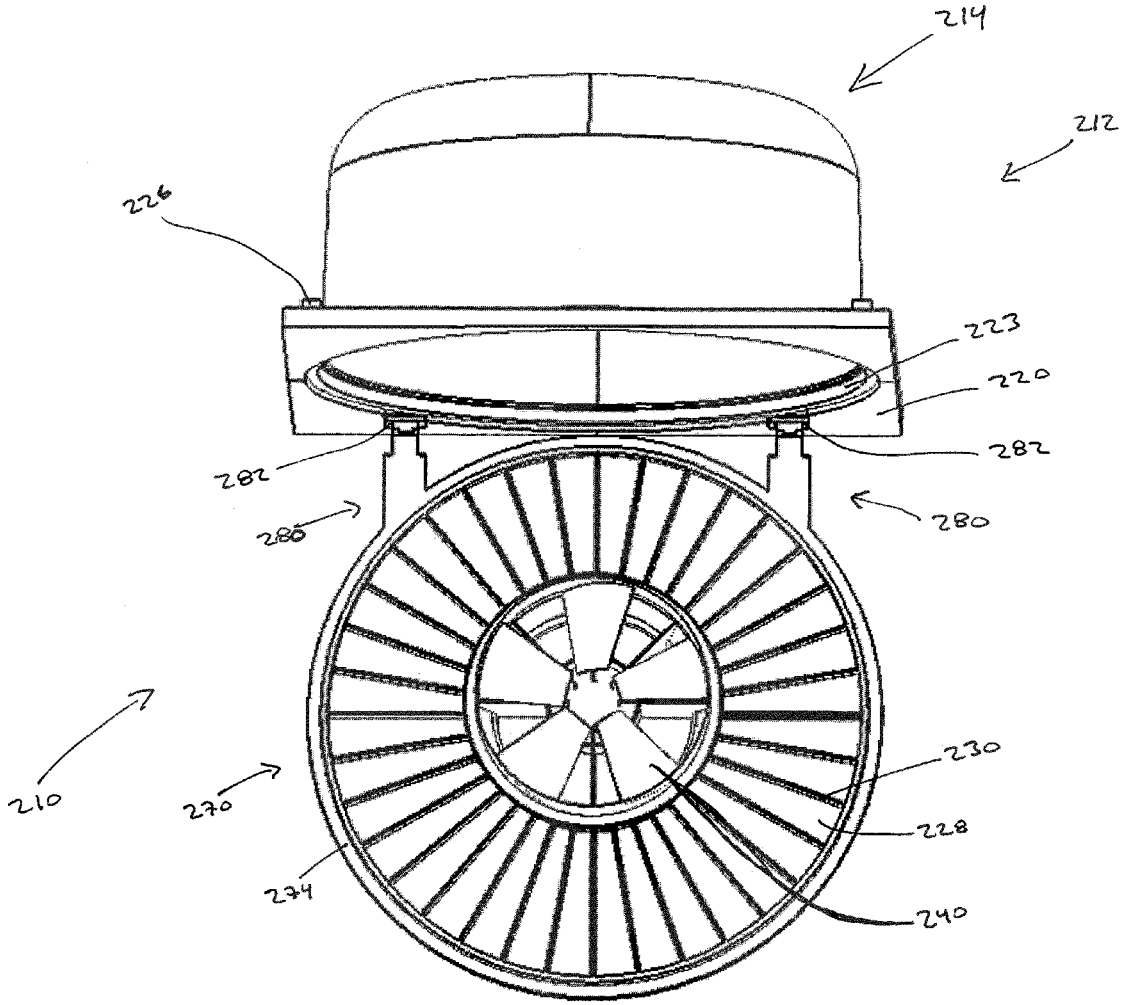
FIG. 21 is a schematic front perspective view of the air moving device of FIG. 18 with a grill assembly in an open position.
Figure 22:
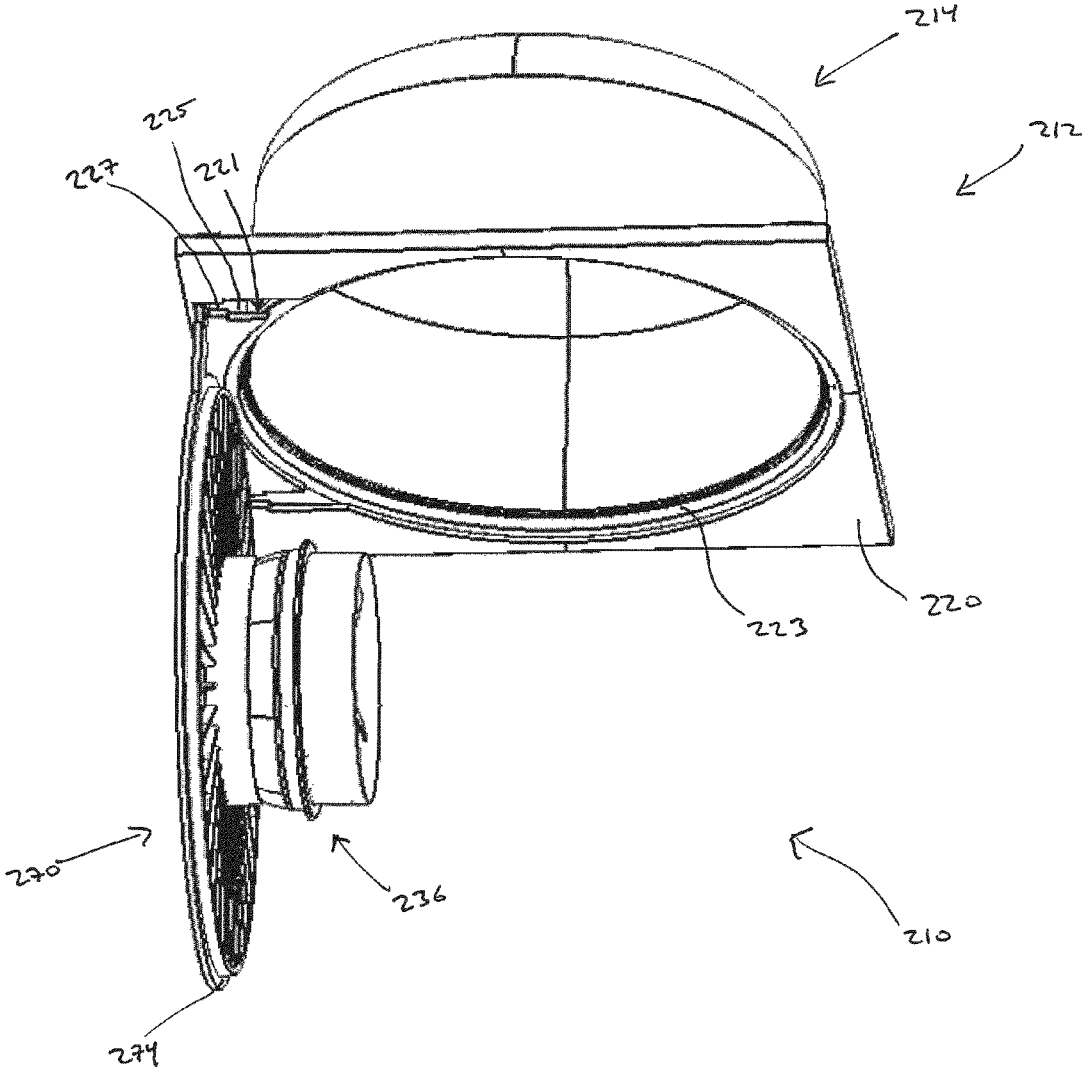
FIG. 22 is a schematic side view of the air moving device of FIG. 21.
Figure 23:
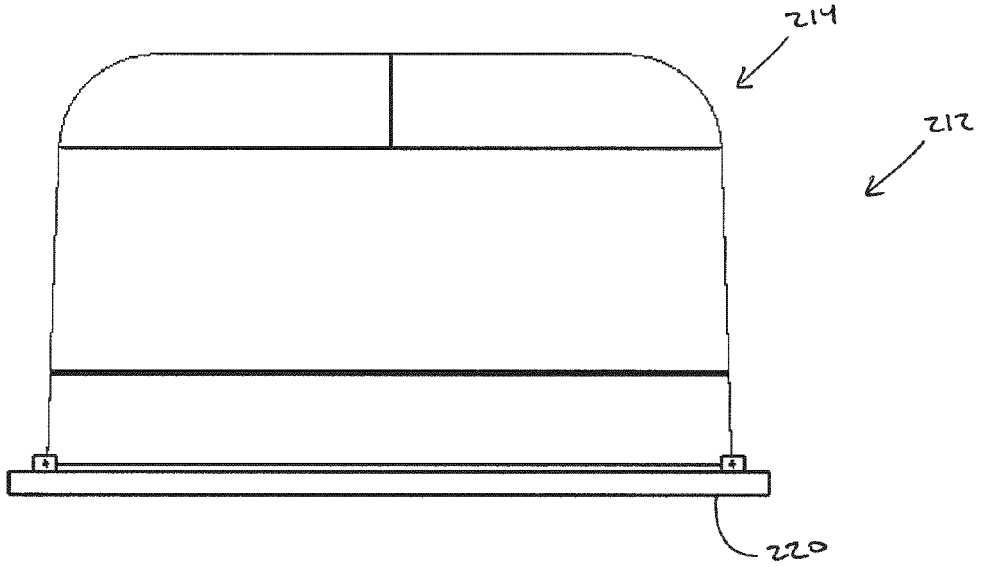
FIG. 23 is a schematic side view of the air moving device of FIG. 22 with the grill assembly separated from the housing member.
Figure 23:
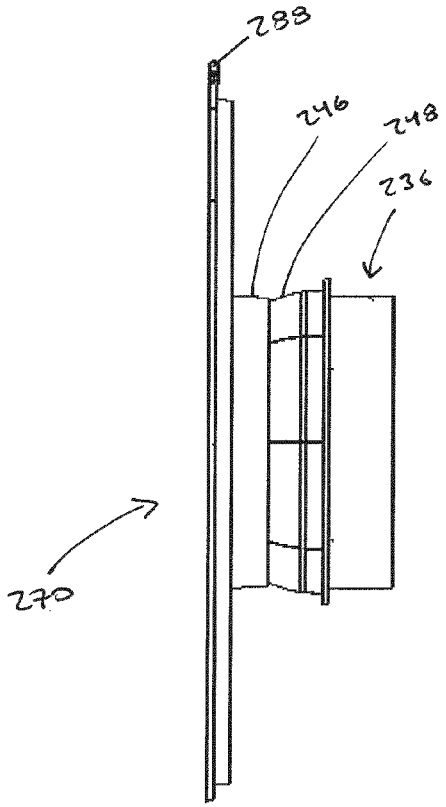

In some embodiments, the grill assembly 270, including any connecting projection 280, can be completely removed from the housing member 212. FIGS. 21-23 illustrate various steps to removing a grill assembly. FIG. 21 is a front view and FIG. 22 is a side view of an air moving device 210 with a grill assembly 270 rotated from a closed to an open position. FIG. 23 is a side view of an air moving device 210 with a grill assembly 270 completely removed from the housing member.

With reference to FIGS. 21 and 22, in some embodiments, before rotating the grill assembly 270, any connecting mechanisms (e.g., screws) between the grill assembly and the housing member 212 are removed or released. The grill assembly 270 can then be rotated about the hinge 282 into the open position. In some embodiments, the ceiling support structure 220 of the housing member can include a seat 223 that can be sized and configured to receive a corresponding lip 274 of the outer rim 274 of the grill assembly.

Figure 24B:
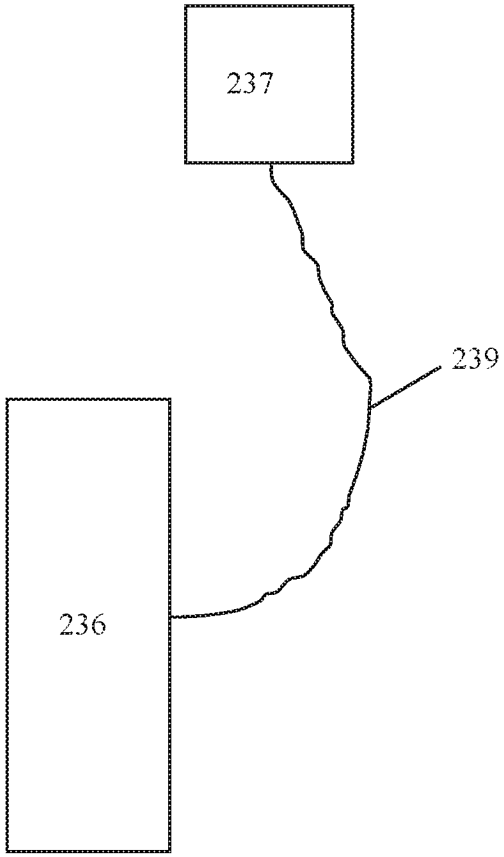
FIG. 24B is a schematic view of the fan assembly of FIG. 24A when the grill assembly is in a rotated position.
Figure 24A:
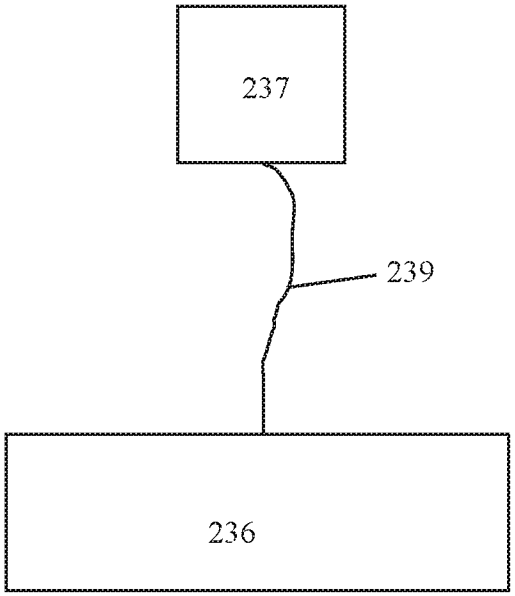
FIG. 24A is a schematic view of a fan assembly connected to an outlet via a cord when the grill assembly is in a first position.

In some embodiments, the grill assembly 270 can include a rotary fan assembly 236, such that the fan assembly can be removed with the grill assembly 270 for easy cleaning, repair, maintenance, etc. This can decrease the cost associated with maintaining the air moving devices within a building as fewer people and working hours are required to remove and maintain the grill assembly, including a fan assembly, and because the whole air moving device does not need to be removed for maintenance. In some embodiments, the fan assembly can be plugged into an outlet either within or outside of the housing member 212 with a cord long enough to allow the fan assembly 236 to rotate as illustrated. For example, FIG. 24A illustrates the fan assembly 236 plugged into an outlet 237 via a cord 239 when the grill assembly 270 is in a first position and FIG. 24B illustrates the fan assembly 236 plugged into the outlet 237 via the cord 239 when the grill assembly 270 is in a rotated position. In some embodiments, the grill assembly 270 can be separate from the fan assembly 236 and can be removed independently. Preferably, when the grill assembly 270 and fan assembly 236 are removed together, they can be later separated to allow for specific maintenance tasks. In some embodiments, the fan assembly 236 can include at least one spherical surface 248 that can be configured to fit within an opening 246 of the grill assembly to thereby allow the grill assembly 270 to act as a gimbal, as described above.

In some embodiments, as illustrated for example in FIG. 22, the ceiling support 220 can include one or more openings or slots 221 configured to receive the connecting projections 280 when the grill assembly 270 is in a closed position. Preferably, as shown in FIG. 18, in the closed position the connecting projections 180 can be flush or generally flush against the lower surface of the ceiling support 220. The openings 221 can have a first, wider portion 225 and a second, narrower portion 227. In some embodiments, the wider portion 225 can be approximately the same width as the wider section 284 of the connecting projection 280. In some embodiments, the narrow portion 227 can be approximately the same width as the narrow section 286 of the connecting projection.

Preferably, the connection member 288 at a distal end of the connecting projection 280 has a width wider than that of the narrow portion 227, but not as wide as that of the wide portion 225. Thus, when the grill assembly 270 has been rotated into the position shown in FIG. 22, the connection member 288 cannot pass through the narrow portion 227 and the grill assembly is prevented from being separated from the housing member 212. However, the grill assembly 270 can be translated laterally until the connecting projection 280 is aligned with the wide portion 225 of the opening 221. Where the connection member 288 is narrower than the width of the wide portion 225, the connection member can pass through the opening 221 and the grill assembly 270 can be removed from the housing member 212, as shown in FIG. 23.

The grill assembly 270 can then be cleaned, further taken apart, repaired, or otherwise modified and then re-attached to the housing member 212. To re-attach, the connecting projection 280 is merely inserted through the wider portion 225 of the opening 221, the device is translated laterally until the connecting projection is at an outer end with the narrow portion 227, and then the grill assembly is rotated at the hinge until it is in a closed position, such as that shown in FIG. 20. It will be understood that the foregoing disassembly/maintenance methods may be performed while the air moving device 210 is installed in a ceiling. For example, the grill assembly 270 can be swung downward from the lower housing section 216 while the air moving device 210 is installed within the ceiling.

The terms "approximately", "about", and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An air moving device comprising:

a housing member forming an interior space within the air moving device, the housing member having an opening that fluidly connects the interior space with air outside of the housing;

a ceiling support structure connected to the housing member and forming an outer peripheral edge of the air moving device;

an air vent grill assembly configured to be positioned at least partially within the housing member, the air vent grill assembly comprising a plurality of air vents for directing a volume of air into the interior space of the air moving device, and at least one projection configured to releasably attach to the ceiling support structure, the projection including a tool-less hinge that allows the air vent grill assembly to rotate relative to the ceiling support structure to a downward position when the air moving device is positioned at least partially within a ceiling structure, wherein the air vent grill assembly is supported by the tool-less hinge positioned when the air vent grill assembly is in the downward position, but wherein the tool-less hinge is configured to enable the air vent grill assembly to be removable from the ceiling support structure without use of tools; and a rotary fan assembly including an impeller mounted on the air vent grill assembly within the interior space of the housing member, wherein the rotary fan assembly and impeller are configured to rotate with the air vent grill assembly when the air vent grill assembly rotates relative to the ceiling support structure about the tool-less hinge;

wherein the ceiling support structure comprises at least one attachment opening configured to receive at least a portion of the at least one projection, and wherein the at least one attachment opening comprises a first portion having a first width and a second portion having a second width less than the first width.

2. The air moving device of claim 1, wherein the at least one projection comprises an elongate connector at one end, the elongate connector having a width less than the first width but greater than the second width.

3. The air moving device of claim 1, wherein the at least one projection comprises a first portion having a first width and a second portion having a second width less than the first width of the at least one projection.

4. The air moving device of claim 3, wherein the first width of the at least one projection is approximately equal to the first width of the at least one attachment opening, and wherein the second width of the at least one projection is approximately equal to the second width of the at least one attachment opening.

5. The air moving device of claim 1, further comprising one or more flow straighteners configured to straighten the volume of air to output the volume of from the air moving device in a substantially columnar manner.

* * * * *